United States Patent [19]

Reimert

[11] Patent Number: 4,757,860

[45] Date of Patent: Jul. 19, 1988

[54] WELLHEAD EQUIPMENT

[75] Inventor: Larry E. Reimert, Houston, Tex.

[73] Assignee: Dril-Quip, Inc., Houston, Tex.

[21] Appl. No.: 839,571

[22] Filed: Mar. 14, 1986

Related U.S. Application Data

[63] Continuation-in-part of Ser. No. 730,378, May 2, 1985, abandoned.

[51] Int. Cl.[4] ..... E21B 33/035

[52] U.S. Cl. ..... 166/208; 166/123; 166/182; 277/117; 277/236; 285/39; 285/140

[58] Field of Search ..... 166/115, 208, 181, 182, 166/206, 217, 123–125; 285/18, 39, 84, 140–145; 277/30, 188 R, 188 A, 236, 116.2, 117, 118

[56] References Cited

U.S. PATENT DOCUMENTS

| | | | |
|---|---|---|---|
| 3,468,559 | 9/1969 | Ahlstone | 285/142 |
| 3,543,847 | 12/1970 | Haeber | 166/208 |
| 3,561,527 | 2/1971 | Nelson | 166/86 |
| 3,736,984 | 6/1973 | Garrett | 166/208 |
| 3,897,823 | 8/1975 | Ahlstone | 166/120 |
| 3,924,678 | 12/1975 | Ahlstone | 166/120 |
| 4,131,287 | 12/1978 | Gunderson et al. | 277/191 |
| 4,460,042 | 7/1984 | Galle, Jr. | 166/208 |
| 4,469,172 | 9/1984 | Clark | 166/115 |
| 4,488,740 | 12/1984 | Baugh et al. | 285/84 |
| 4,497,371 | 2/1985 | Lindsey, Jr. | 166/377 |
| 4,550,782 | 11/1985 | Lawson | 166/382 |
| 4,583,746 | 4/1986 | Lawson | 277/1 |

FOREIGN PATENT DOCUMENTS

| | | | |
|---|---|---|---|
| 3200722 | 7/1983 | Fed. Rep. of Germany | 166/208 |

OTHER PUBLICATIONS

P. 5838–D of the 1984–1985 issue of the Composite Catalog of Oilfield Equipment Services.

*Primary Examiner*—George A. Suchfield
*Assistant Examiner*—Hoang C. Dang
*Attorney, Agent, or Firm*—Vaden, Eickenroht, Thompson & Boulware

[57] ABSTRACT

There are disclosed several forms of subsea wellhead equipment of the type in which casing hangers connected to the upper ends of successively smaller diameter casing strings are adapted to be lowered into and landed within the bore of a casing head, which is connected to an outermost string at the subsea level, to suspend the strings within the outermost casing of the well bore, and wherein openings in each hanger which connect the annulus between each casing string and the next outer string with the space between the hanger and the bore of the head, to permit cement returns to circulate therethrough as the string is cemented within the well bore, are adapted to be closed off, when the casing has been cemented, by means of a seal assembly lowered into and locked down within the space.

53 Claims, 15 Drawing Sheets

WELLHEAD EQUIPMENT

This application is a continuation-in-part of my copending application, Ser. No. 730,378, entitled "Wellhead Equipment", and filed May 2, 1985, now abandoned.

This invention relates generally to subsea wellhead equipment of the type in which casing hangers connected to the upper ends of successively smaller diameter casing strings are adapted to be lowered into and landed within the bore of a casing head which is connected to an outermost string at the subsea level in order to suspend the strings within the outermost casing of the well bore, and wherein openings in each hanger which connect the annulus between each casing string and the next outer string with the space between the hanger and the bore of the head to permit cement returns to circulate therethrough as the string is cemented within the well bore, are adapted to be closed off, when the casing has been cemented, by means of a seal assembly lowered into and locked down within the space.

In one of its novel aspects, this invention relates to improvements in equipment of this general type in which successive hangers are supported on one another so that the load of all of the hangers as well as the casing supported from the hangers, and the downward force due to test fluid applied to the seal assembly is supported by a seat in the bore of casing head on which the lowermost hanger connected to the outer string is landed. In another of its novel aspects, it relates to improvements in equipment of this general type in which each seal assembly is lowered with a hanger by means of a running tool which holds the seal assembly raised above the space as the hanger is landed therein, and then, through manipulation of the drill string on which the running tool is suspended as well as the application of fluid pressure, causes the seal assembly to be lowered into, energized and locked down within the space. In still another of its novel aspects, this invention relates to improvements in equipment of this general type, or other apparatus in which an annular space between remotely located members is to be closed, wherein the seal assembly is adapted to form a metal-to-metal as well as a resilient seal with respect to both the bore of the casing head and the hanger.

U.S. Pat. No. 4,488,740 shows equipment of the first described type in which a so-called "breech block" is lowered into and landed on a seat in the bore of the casing head to provide a sufficiently large surface to support the load of all the hangers. Thus, it is possible to lower substantially larger bits through the seat, and thus drill substantially large bore holes, than with such equipment wherein the seat is itself of the required size. However, in the installation of such equipment, the breech block is first lowered and landed on the seat, and the hanger for the outer string is then lowered and landed on both the seat and the upper support surface of the breech block, thereby requiring two "trips" as well as different running tools. Also, in order to be installed in the head, the block must be rotated as well as lowered so as to engage interrupted teeth about it with interrupted support grooves on the bore of the head.

Page 5838-D of the 1984–1985 issue of the *Composite Catalog of Oilfield Equipment Services* shows somewhat similar equipment offered by National Supply Company, a division of Armco, Inc. In this case, however, a load supporting split ring is carried by the hanger for expansion and contraction between a normally expanded position in which teeth about the ring fit within grooves about bore of the head beneath the seat in the head on which the hanger lands so as to locate its upper load supporting surface in position to support the hanger, and a contracted position in which the teeth may move into and out of positions opposite the grooves. However, if one or more of the grooves is filled with debris, the ring may not be able to expand outwardly to seat its teeth on the grooves.

U.S. Pat. No. 4,460,042 shows equipment in which a split support ring is instead of a type which is normally contracted, but also adapted to be forced into and held within the grooves upon lowering of the hanger body with respect to the split ring as the split ring is carried about the hanger beneath the hanger seat by a solid ring releasably connected to the body. In this case, however, the full load of the hanger is transmitted to the casing head through the rings.

It is an object of this invention to provide equipment having the advantages, without the disadvantages, of the equipment above described, in that it enables teeth on a support ring lowered with the hanger to be positively forced into and held within locking position within grooves on the hanger, despite the presence of debris within the grooves, and in which the load of the hanger is transmitted directly as well as through the ring to the head.

U.S. Pat. No. 3,468,558 shows equipment of the second described type in which the running tool includes a mandrel suspended from the drill string and releasably connected to the hanger to permit the hanger to be lowered into landed position within the bore of the head, and a tubular body carried by the mandrel and releasably connected to the seal assembly to support it above the space between the hanger and head. When the hanger is landed, the mandrel is released from it and lowered into the bore of the hanger in order to lower the seal assembly with the tubular body into sealing position within the annular space. However, the need for lowering it requires that a different running tool be provided for each hanger and seal assembly. Also, the means by which the mandrel is releasably connected to the hanger requires the running of a dart into the tool to permit fluid pressure to be applied to a complex fluid pressure responsive operator.

U.S. Pat. No. 3,809,158 shows similar equipment in which the runing tool includes a sleeve releasably connected to the hanger and to the tubular body to the running tool to support the seal assembly above the annular space, so that upon disconnection of the body from the sleeve, the seal assembly may be lowered therewith into the annular space without lowering the mandrel into the bore of the hanger. However, in order to retrieve the running tool, it's necessary to release the tubular body from the seal assembly and then raise it for threaded reconnection to the sleeve, so that the sleeve may be rotated with the tubular body to release the mandrel from the hanger. The connection and release of the various parts requires that considerable torque be transmitted to the mandrel through the drill string. Also, of course, if the reconnection cannot be made, the sleeve cannot be released from the hanger in order to permit the running tool to be retrieved.

As also shown in this latter patent, when the seal assembly is lowered and set, it is held down in set position along with the hanger by a lock ring carried thereby and expanded into a locking groove in the bore of the head. Due to stacking tolerances, especially upon landing of the hangers one above the other, the locking ring may not be opposite the groove, so that the locking ring can't be locked within the groove in order to force the seal assembly into the set position.

U.S. Pat. No. 3,871,449 shows similar equipment in which the seal assembly is supported in its raised position as it is lowered with the hanger on the running tool. Thus, the hanger is threadedly connected to the mandrel on the running tool, and the tubular body is releasably supported to support the seal assembly in its raised position by a sleeve supported on the hanger. When the hanger is landed, the mandrel is rotated to release from the hanger and to raise the mandrel to a position in which the sleeve releases the tubular body and seal assembly for movement downwardly under the influence of a spring pressed collar carried by the mandrel to which the assembly is connected. Since the mandrel is raised in order to release it from the hanger and unlock the locking sleeve, it is not possible to set the seal assembly merely by weight, but instead the seal assembly must be lowered by spring pressure through the collar to a position in which it may be threadedly connected to the hanger and then fully set by the application of torque to the running tool to move the seal assembly downwardly over threads connecting it to the hanger. If fluid pressure is applied to the seal assembly, threads on the mandrel which were disconnected from those of the hanger may be forced downwardly against them and thereby jam or injure the threads. Also, the spring force of the collar may not be sufficient to lower the seal assembly to a level at which it may be threadedly connected to the hanger.

U.S. Pat. No. 3,897,823 shows equipment similar to that above described, but in which the hanger is not connected to the mandrel of the running tool, but instead to another sleeve of the running tool which is supported by the mandrel for vertical movement with respect to it. Thus, when the hanger is landed, the mandrel may be rotated to lift the second-mentioned sleeve, rather than the mandrel, to release its threaded connection from the hanger and release the support of the tubular body from the first-mentioned sleeve so that the seal assembly may be lowered with the tubular body into the annular space between the hanger and the head in response to weight. However, when the second-mentioned sleeve is released from the hanger, its threads apply load to threads on the hanger beneath them as downward force is applied to the second-mentioned sleeve by test pressure acting over a piston on the tubular body above the second-mentioned sleeve. Also, in order to retrieve the running tool, it is necessary to connect the second sleeve to the first mentioned sleeve, and rotation of the second mentioned sleeve with respect to the hanger in order to release it therefrom requires dynamic seals between them.

It is another object of this invention to provide equipment of this type above described which overcomes these problems, and, more particularly, does not require connection and disconnection of the parts of the running tool, which does release the running tool from the hanger before the seal assembly is released therefrom, and in which the seal assembly may be "weight set", without, however, applying unnecessary loads to threaded connections between them, reconnecting parts of the running tool prior to retrieval, or unnecessary dynamic seals.

U.S. Pat. No. 4,324,422 shows equipment of the last described type wherein the seal assembly, which is lowered between concentric cylindrical surfaces of the hanger and bore of the head, comprises inner and outer resilient seal rings of elastomeric material and upper and lower metal bodies above and below the seal rings and having inner and outer lips extending downwardly and upwardly, respectively, over ends of the seal rings. The lower metal body is supported on a shoulder of the hanger at the lower end of the space, and the upper body thereof is threadedly connected to the hanger so that torque may be applied thereto in order to force the upper metal body downwardly to cause the seal rings to expand the lips into metal to metal and resilient sealing engagement with the hanger and bore. Thus, the metal lips are held in sealing engagement by the resilient seal ring and cannot be tested without the seal ring.

The metal bodies also have vertically extending parts which pass between the seal rings and are adapted to hook on to one another upon raising of the upper metal body. If it is necessary to retrieve the seal assembly, these members may part when subjected to an upward strain, thereby leaving a lower portion in the space. Also, considerable right hand torque must be applied to the running tool to expand the metal lips and seal ring into sealing engagement, and considerable left hand torque must be applied thereto in order to release them from such engagement in the event it is necessary to retrieve the assembly.

U.S. Pat. No. 4,488,740 shows equipment having a somewhat similar seal assembly which is also adapted to be lowered between concentric cylindrical surfaces of the hanger and bore of the casing head, and which comprises inner and outer seal rings of elastomeric material carried within annular pockets formed between adjacent legs of the "Z" shaped metal member on the inner and outer sides thereof, respectively, whose upper and lower ends are connected to upper and lower metal bodies. The connection of the ends of the legs of the "Z" shaped member to the metal bodies, as well the connection of the ends of the legs of the members to one another, are flexible so as to permit the member to be flattened in a vertical sense as the upper metal body is forced down toward the lower, and thus expand the edges of the flexible connections as well as the seal ring between the alternate legs of the member to form metal to metal and resilient seals. However, this assembly suffers from shortcomings similar to that of the previously described assembly in that torque must be applied to the running tool in order to raise and lower the upper body through its threaded connection to the hanger in order to set or unset the seal assembly. Also, the "Z" shaped member may part at one or more of its flexible connections as an attempt is made to retrieve the assembly.

The aforementioned equipment offered by National Supply Company also includes a seal assembly comprising a one piece metal body having seal rings carried in its inner and outer sides to form metal to metal as well as resilient seals with the bore of the head and the outer surface of the hanger as the metal body is forced downwardly between them. The surface of the hanger and the inner surface of the metal body are frusto-conically shaped, with the inner surface of the metal body forming a somewhat larger acute angle with respect to the vertical than the outer surface of the hanger so that the lower end of the metal body is forced radially outwardly as it is wedged into space. Although this has considerable mechanical advantage, substantial downward force may nevertheless be required to cause the lower end of the body to flex outwardly as it is wedged into the space. Also, the metal to metal seal of the assembly is not pressure energized by fluid pressure from below the annular space, and, in fact, such pressure would tend to unset the assembly. Still further, the seal assembly is run separately of the hanger and the sealing surfaces on the inner and outer ends of the metal body are exposed to possible damage as they are lowered into the space. Furthermore, the resilient seals are not pressure energized through deflection of the metal to metal seals as in the case of those assemblies previously described, thus requiring greater force to set the seal assembly.

It is a further object of this invention to provide equipment having a seal assembly of the type above described which, like that last described, may be weight set with substantial mechanical advantage, and retrieved without parting, but which is of such construction that it requires less downward force to set it, in which its sealing surfaces are protected, and in which both the metal to metal and resilient seals are pressure energized from below as well as from above the space.

In the equipment offered by National Supply Co., as well as in U.S. Pat. No. 3,897,823, the tubular body of the mandrel running tool to which the seal assembly is connected includes a piston arranged to be urged downwardly by test pressure below blowout preventer rams closed about the drill pipe on which the running tool is lowered. However, due to the large forces required necessary to set the seal assemblies of such equipment, and especially that of U.S. Pat. No. 3,897,823, the pistons are of large cross sectional area. Also, in the equipment of U.S. Pat. No. 3,897,823, the pistons have air chambers on one side which are susceptible of leakage.

In both cases, the seal assembly is adapted to be locked down, either by connection to the head or the hanger, by locking elements carried by the seal assembly for movement into and out of locking position with respect to a groove about the head or hanger. Thus, upon release of the tubular body from the seal assembly, the tubular body may be lowered to force the locking parts into locking position. In the National Supply Company equipment, the piston is arranged to engage and force the locking parts to locking position as it transmits force through the locking parts to the seal assembly on which they are supported. Apparently in view of the large force required to set the seal assembly with the first mentioned piston, the tubular body of the running tool of U.S. Pat. No. 3,897,823, has another, separate piston which is responsive to test pressure to lock the seal assembly down. In addition to complicating the construction of the running tool, this latter piston also requires a gas chamber which may leak.

Still a further object of this invention is to provide equipment of the type above described in which the seal assembly may be set with much smaller forces, and possibly weight alone, so that the running tool requires only a piston of relatively small cross sectional area, and, more particularly, a piston whose area need not be substantially greater than that necessary to move the locking parts of the seal assembly to their locking positions.

These and other objects are accomplished, in accordance with the illustrated forms of the invention, by means of well equipment of the type described having a casing hanger which includes a main body on which the shoulder for landing it on a seat in the head is formed, and tooth segments which are carried by the main body beneath its shoulder for lowering therewith into the bore of the head for disposal opposite a groove in the bore of the head beneath its seat. More particularly, a means is provided on the main body for expanding the tooth segments into supported position on the load supporting surface of the groove and holding them in supported position as the main body is lowered into landed position on the seat and on the tooth segments. As a result, the supporting tooth segments may be moved into supported position, even though the groove may be filled with debris or other foreign matter. In multiple hanger wellhead equipment of the type contemplated by this invention, the main body of the hanger has a seat about its bore on which an inner casing hanger connected to an inner casing may be landed to suspend the inner casing within the outer casing.

More particularly, the tooth segments are joined to one another to form a split support ring of a construction which normally assumes a contracted position and thus provides a detent which holds the main body of the hanger in a position above the seat, as the tooth segments are moved into a position opposite the groove, and then releases the main body for movement downwardly to force the tooth segments into and hold them in supported position in the groove and to land on the seat. Thus, the casing hanger also includes a carrier ring which is supported by the main body for lowering with it into a supported position on the casing head, and the support ring is supported by the carrier ring for expansion and contraction with respect thereto to dispose the tooth segments opposite the groove in the head when the carrier ring is supported by the head. The tooth segments are expanded by means on the main body as the main body is lowered into a landed position on the seat in the head to transmit the load thereof directly to the head. Also, the main body of the hanger is landable on the carrier ring as the main body is lowered into landed position on the seat in the head, thereby providing a second support area within the head for supporting the hanger and transmitting its loads through the carrier ring and support ring to the head. The main body of the hanger has a cam surface thereon which supports it from the support ring and which forces the support ring to expanded position, and a generally cylindrical surface above its cam surface which is slidable over the inner side of the support ring to hold it in expanded position, as the main ring is lowered toward the seat of the head. In the illustrated forms of the invention, the upper end of the carrier ring is landed on the seat of the head to support it therefrom, and the main body of the hanger is landable on the upper end of the carrier ring.

In accordance with other novel aspects of the invention, the outer surface of the casing hanger above its shoulder is tapered upwardly and inwardly at a relatively small angle with respect to the vertical to form a frusto-conically shaped annular space between it and a cylindrical portion of the bore of the head. The seal assembly which is lowerable into this space for closing it includes a metal body having a lower inner wall whose inner side is also tapered at an angle substantially parallel to that of the outer surface of the hanger, and has means thereon which is slidable downwardly along the hanger surface to flex the inner wall outwardly. Upper and lower legs extend from the outer side of the wall so that, when inner wall is flexed outwardly, their outer ends are moved into metal to metal sealing engagement with the bore of the casing head. More particularly, a first of the legs extends upwardly and outwardly and a second of the legs extend downwardly and outwardly from the inner wall at an angle with respect to the horizontal, so that, with their outer ends engaged with the bore, the first leg is flexed upwardly and the second leg is flexed downwardly by the outwardly flexing inner wall as the seal assembly continues to be lowered into the annular space.

Although the inner wall is outwardly flexible and relatively thin as compared with the upper and lower metal bodies of the seal assembly, it is nevertheless sufficiently strong to prevent parting or rupturing if it is necessary for an upward force to be applied thereto in order to retrieve the seal assembly from within the annular space. Furthermore, fluid pressure from either above or below the assembly will force the legs on the outer side of the wall into even tighter engagement with the bore of the head.

In the preferred and illustrated forms of the invention, the seal assembly includes resilient seals for backing up the metal to metal seals between the metal body of the seal assembly and the hanger and head. Thus, resilient seal means is contained about the outer side of the inner wall above the first leg and below the second leg for sealably engaging the bore of the casing head, and thus in position to be compressed and thereby more tightly engaged with the bore upon flexing of the legs, and resilient means is carried about the inner side of the inner wall for sealably engaging the outer surface of the hanger. Also, the means on the inner wall slidable along the hanger surface comprises a first rib about the inner side generally vertically intermediate the intersection of the legs with the inner wall, and there are second and third ribs on the inner side of the wall above and below the first rib which are slidable over and forced inwardly against the hanger surface as the inner wall is flexed outwardly.

In one illustrated form, the first leg is above the second leg, and the resilient seal means about the outer side of the wall comprises an upper seal member contained within a recess above the upper leg and a lower seal member contained within a recess below the lower leg. In another illustrated form, the second leg is above the first, and the resilient seal means about the outer side of the wall comprises a seal member contained within a recess between the first and second legs.

Although the seal assembly has particularly utility in connection with the wellhead equipment of the type described, it is contemplated that, as previously noted, it may also be used in connection with other apparatus having a similarly shaped annular space between first and second members which is to be closed by the seal assembly lowered into the space from a remote location.

According to still further novel aspects of the invention, the seal assembly is releasably connected to the tubular body of the running tool which is carried by the mandrel for rotation therewith for lowering on a drill string to which the mandrel is connected, and a first sleeve is supported by the mandrel for vertical movement with respect thereto and is supported on and sealably engaged with the hanger, while being held against rotation with respect to the hanger while so supported. More particularly, a second sleeve is threadly connected to the first sleeve and connected to the tubular body for rotation therewith and axial movement with respect thereto, in response to rotation of the mandrel, between a lower position, supporting the tubular body in a raised position in order to support the seal assembly above the annular space, and an upper position releasing the tubular body to permit the seal assembly to be lowered into the annular space and forced downwardly to cause it to seal with respect to the bore and the hanger. More particularly, first sleeve is connected to the hanger, when the sleeve is in its lower position, and then released therefrom, when the second sleeve is raised to its upper position, and a means is provided for locking the seal assembly to the hanger to permit the running tool to be retrieved when the tubular body is released from connection to the seal assembly.

The seal assembly may be pressure energized, upon closing of the blowout prevent rams about the drill pipe and the supply of fluid to the space above the seal assembly. Thus, the test fluid is effective over the seal assembly, which has already been set by weight, to urge it into even further downwardly into the space and thus into tighter sealing engagement with the hanger and bore of the head. For this purpose, and in accordance with one form of the invention, the tubular body of the running tool is vertically reciprocable with respect to the mandrel, so that, even if the rams hold the drill pipe from downward movement, the tubular body permits the seal assembly to be forced downwardly by test fluid. Then, upon opening of the rams and disconnection of the tubular body from the seal assembly, the drill pipe may be lowered to in turn lower the tubular body in order to lock the seal assembly to the hanger, following which the body may be raised from the seal assembly to permit retrieval of the running tool from the well bore.

In the above described form of the invention, the means releasably connecting the seal assembly to the tubular body comprises a pin on one and a slot on the other which, in rotative position permits the seal assembly to be raised or lowered with the tubular body, and, in another rotative position, enables the tubular body to be lowered with respect to the seal assembly to lock it to the hanger and then raised therefrom, and the running tool to be raised from the hanger and seal assembly in response to lifting of the drill string. Thus, the running tool may be retrieved without transmitting torque through the drill pipe and running tool to disconnect the seal assembly from the hanger, as is required in some prior art equipment of this type.

In another illustrated form, the tubular body includes a piston which, upon disconnection from the seal assembly, is forced downwardly by the test pressure to lower the actuator body or locking sleeve, and thereby lock the seal assembly to the hanger, as test pressure acts over the seal assembly to pressure energize it. Thus, as compared with the first described form, the seal assembly is not unset and raised with the running tool even if the running tool is lifted following the supply of test fluid and while the seal assembly is still connected to the tubular body. That is, even if the running tool is accidentally raised before the supply of test pressure, it need only be lowered back down to engage the tubular body with the actuator body to lock the seal assembly to the hanger. Also, of course, since the seal assembly is already set due to weight, and further due to the large mechanical advantage previously discussed, the piston need not be essentially larger than that needed to provide force necessary to lock the seal assembly to the hanger.

In accordance with still another form of the invention, the tubular body of the running tool includes a first portion which is releasably connected to the body of the seal assembly, and a second portion on which the piston is formed to permit it to be lowered with respect to the first portion in order to impart a downward force to the actuator body or locking sleeve independently of downward movement of the first portion. Thus, the connection of the seal assembly body to the second portion of the tubular body need not comprise a pin and a slot which requires rotation of the drill pipe to release the tubular body for lowering with respect to the body of the seal assembly, but instead need only comprise connecting parts for transmitting vertical force between them in order to weight set the seal assembly and then raise the running tool from the hanger and seal assembly. Preferably, the first and second portions of the tubular body are releasably connected by detent means so as to initially transmits downward force due to test pressure acting over the piston means to the first portion as well as the second portion, and thereby urge initially the seal assembly downwardly. As in the prior described form, however, the piston is of only small cross sectional area since its primary purpose is to lock the seal assembly down.

In the drawings, wherein like reference characters are used throughout to designate like parts:

FIGS. 1A and 1B are half vertical sectional views of the upper and lower portions of a hanger, seal assembly and running tool constructed in accordance with the present invention, and as they are lowered on a running tool into the bore of a casing head to land a carrier ring of the hanger on the seat about the head, and with the seal assembly supported by the running tool in a position above the annular space between the bore of the casing head and an outer surface of the casing hanger;

Figure 5:
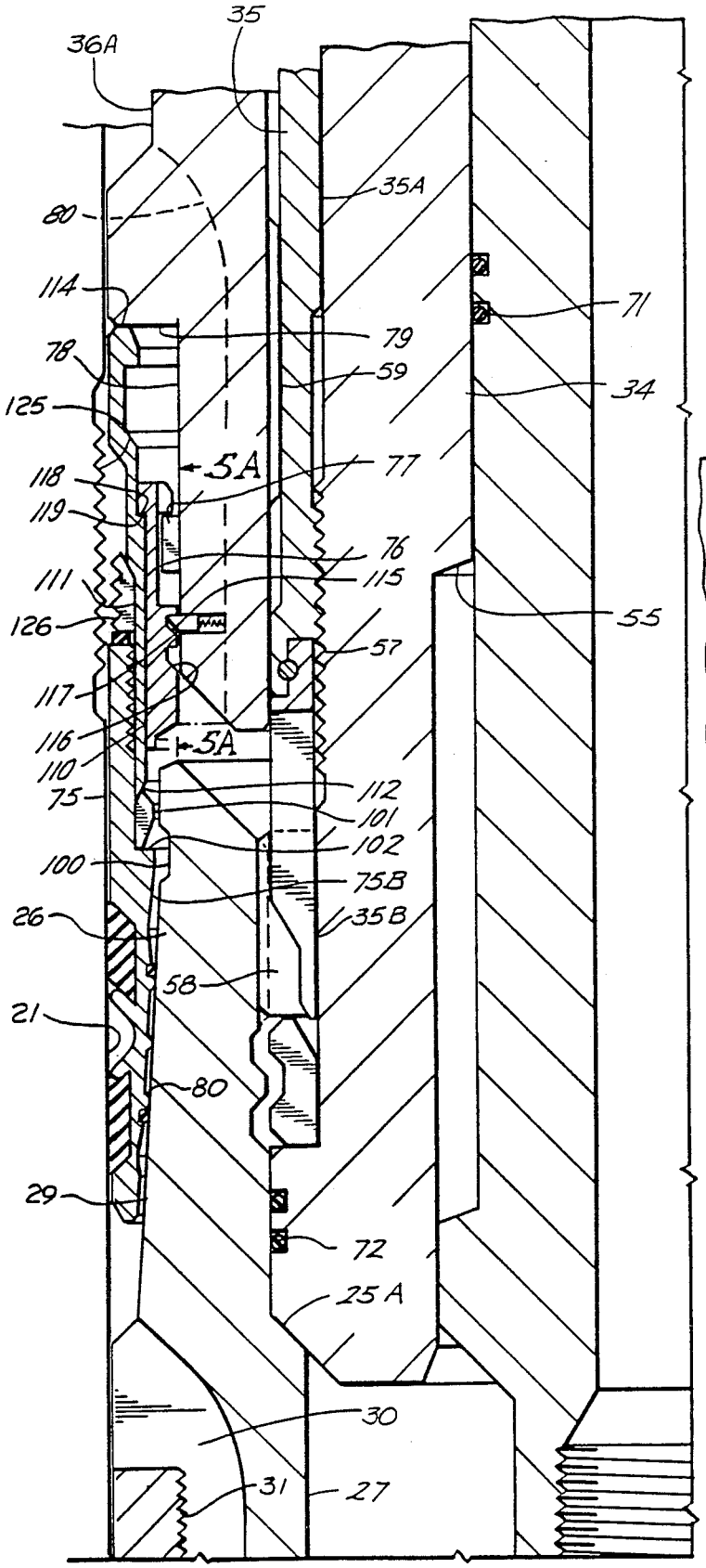
Figure 5A:
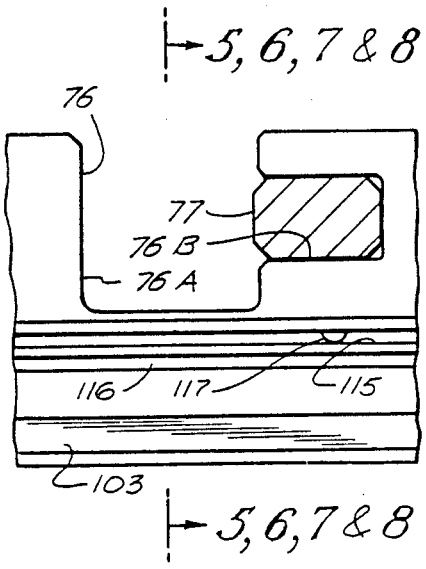
Figure 6:
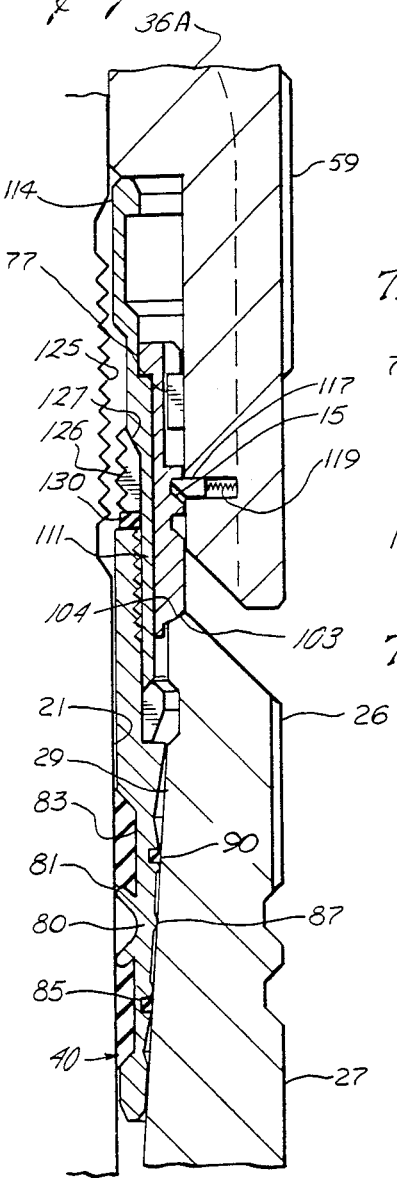
Figure 7A:
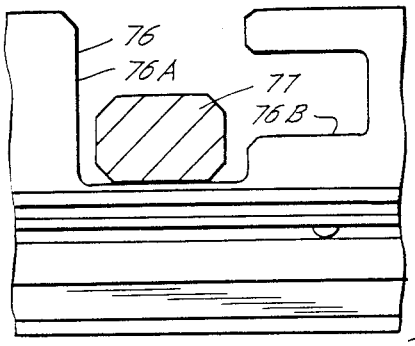
Figure 7:
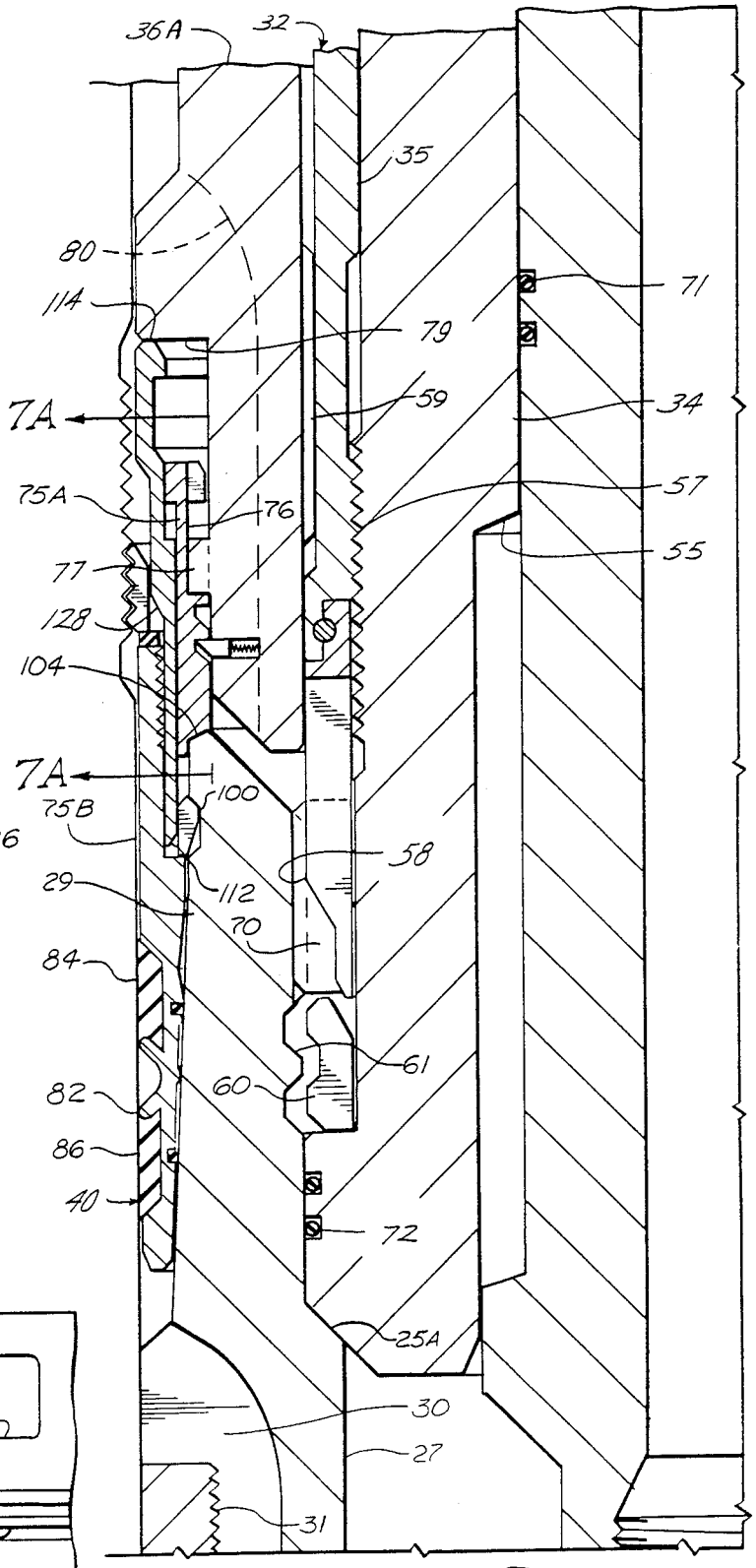
Figure 8:
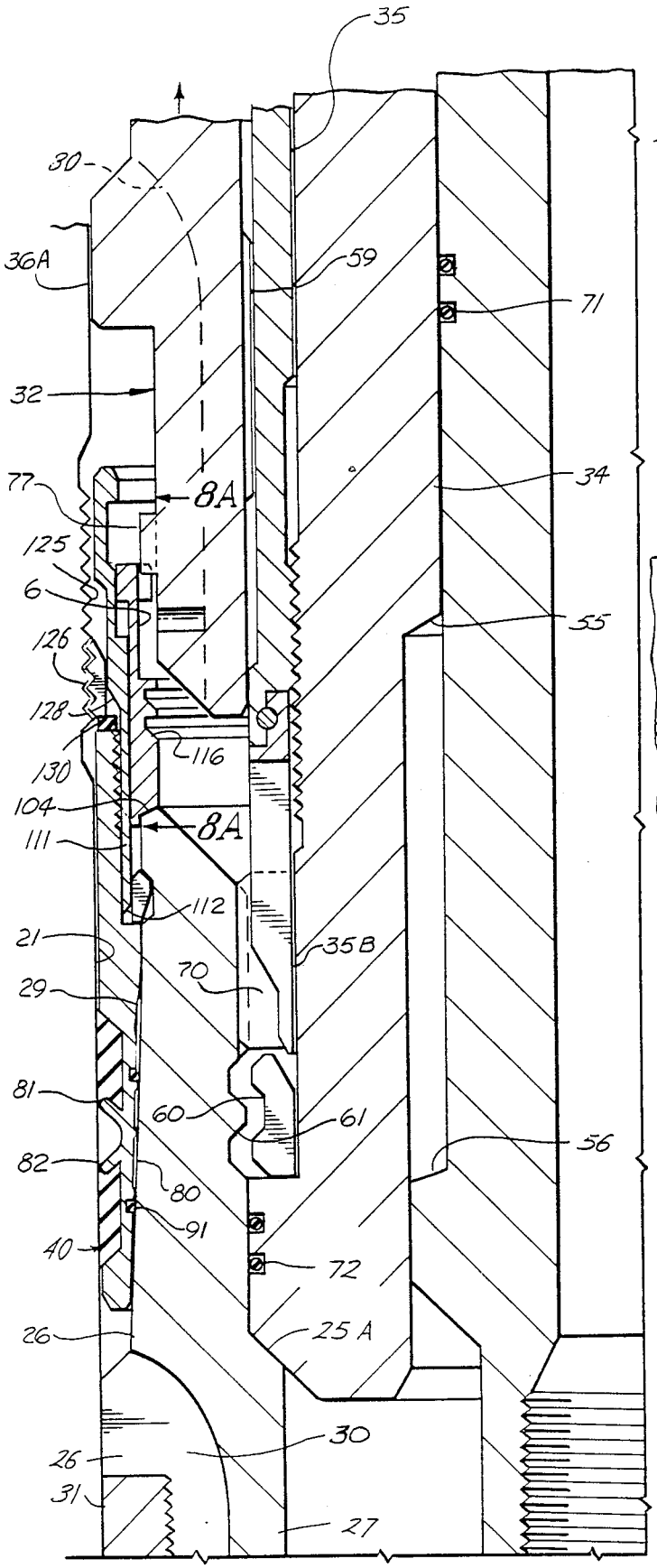
Figure 8A:
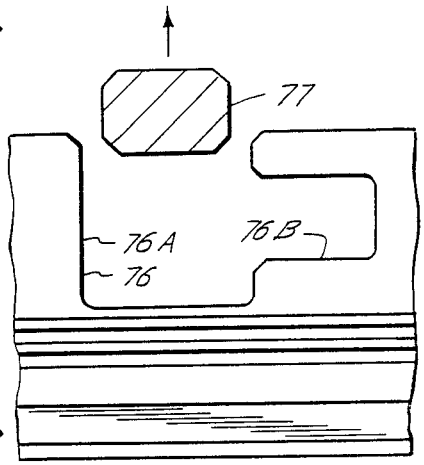
Figures 13A, 13B:
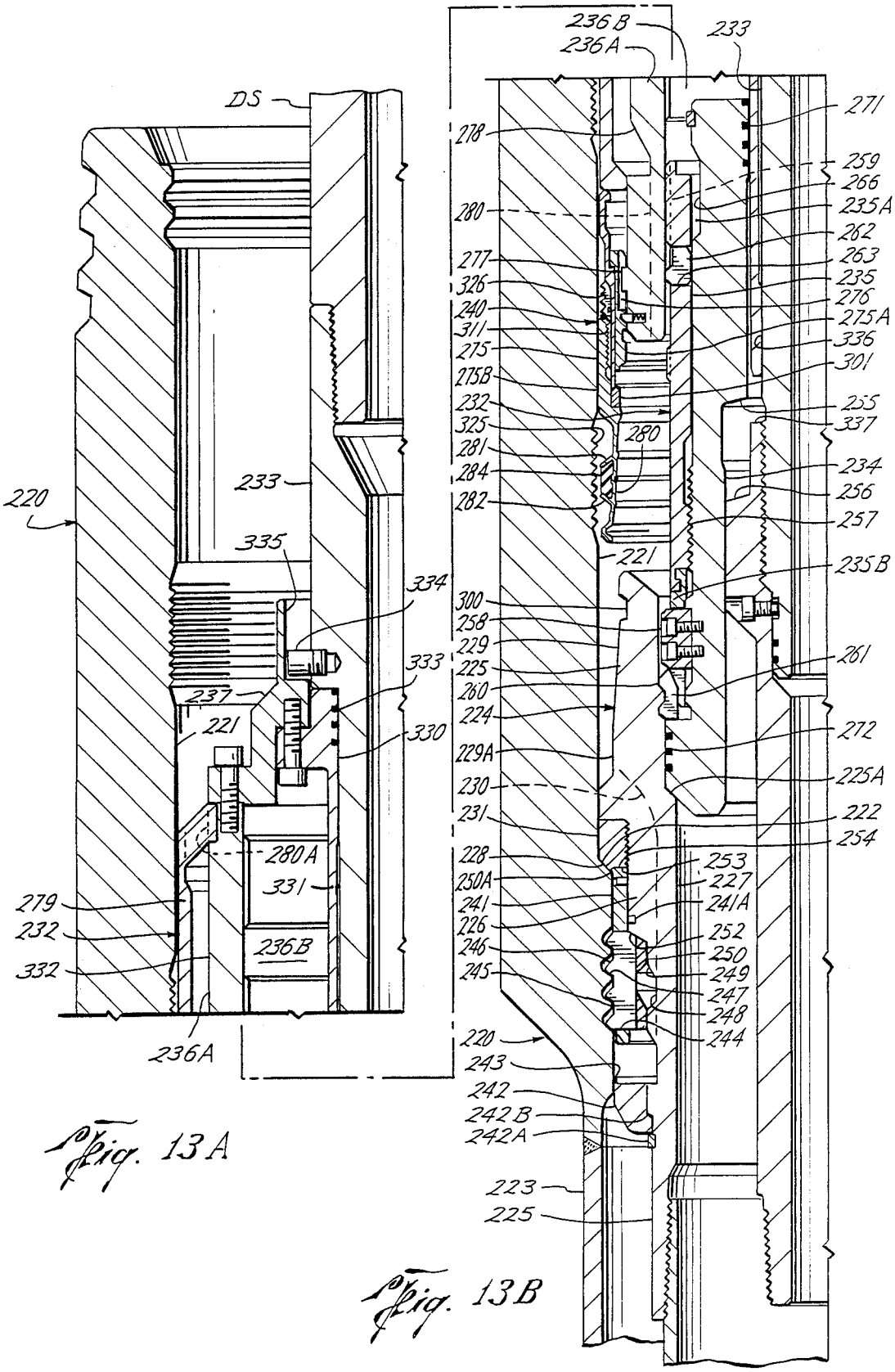
Figure 14:
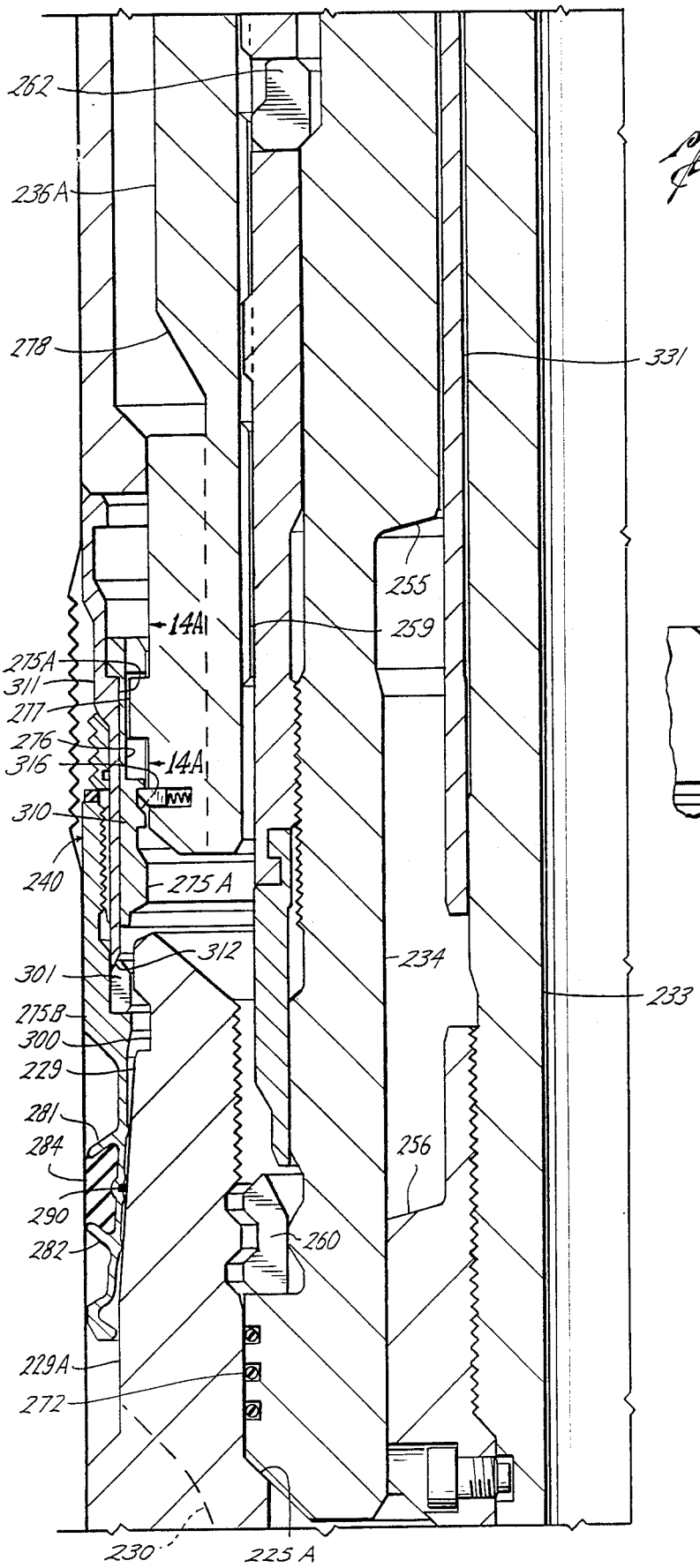
Figure 14A:
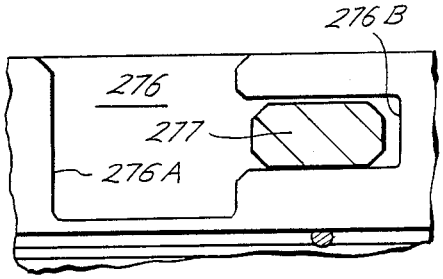
Figure 9:
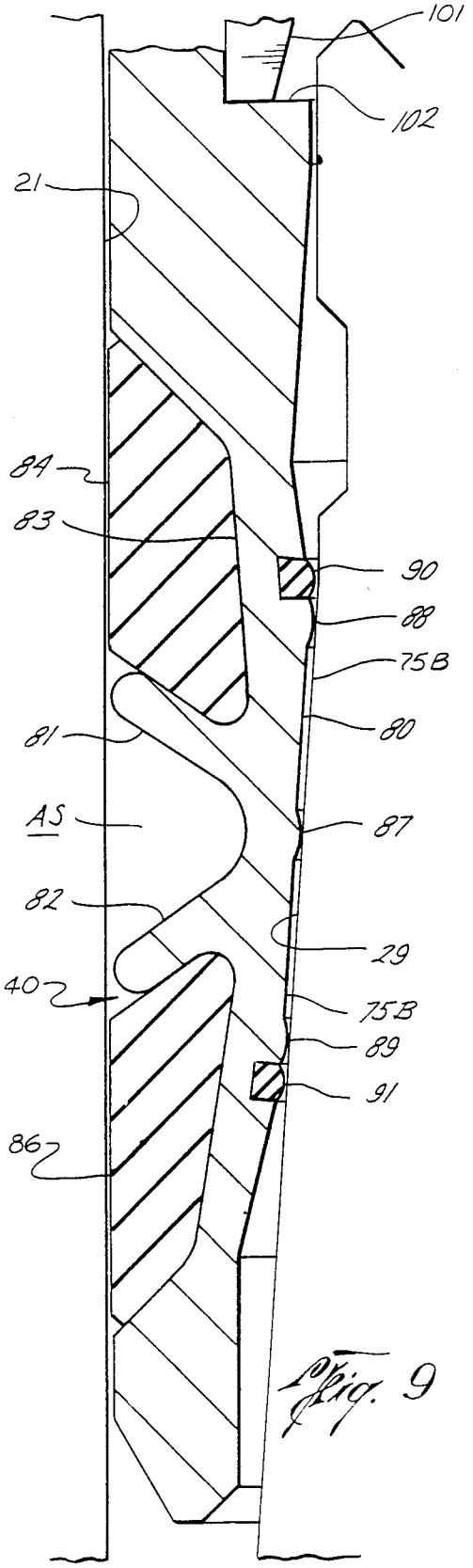
Figure 10:
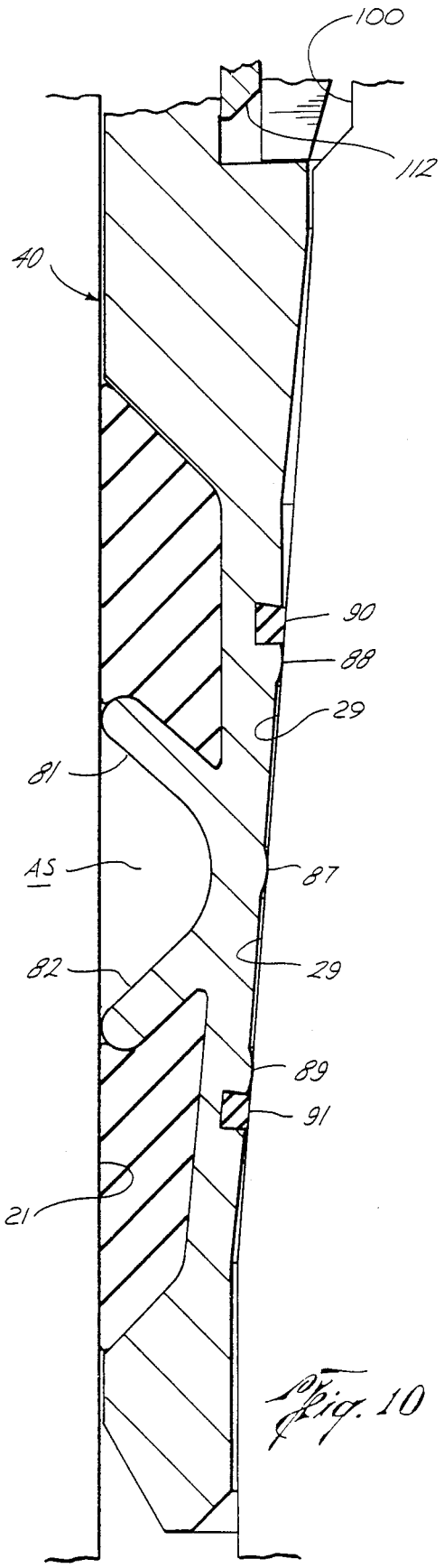
Figure 11:
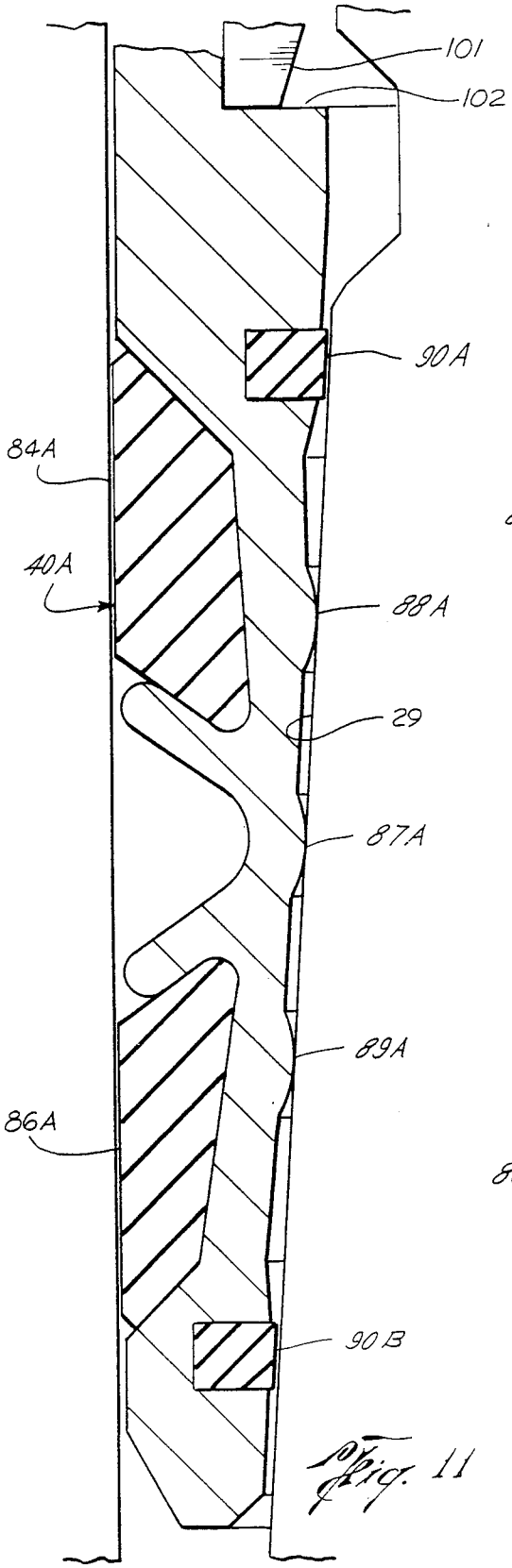
Figure 12:
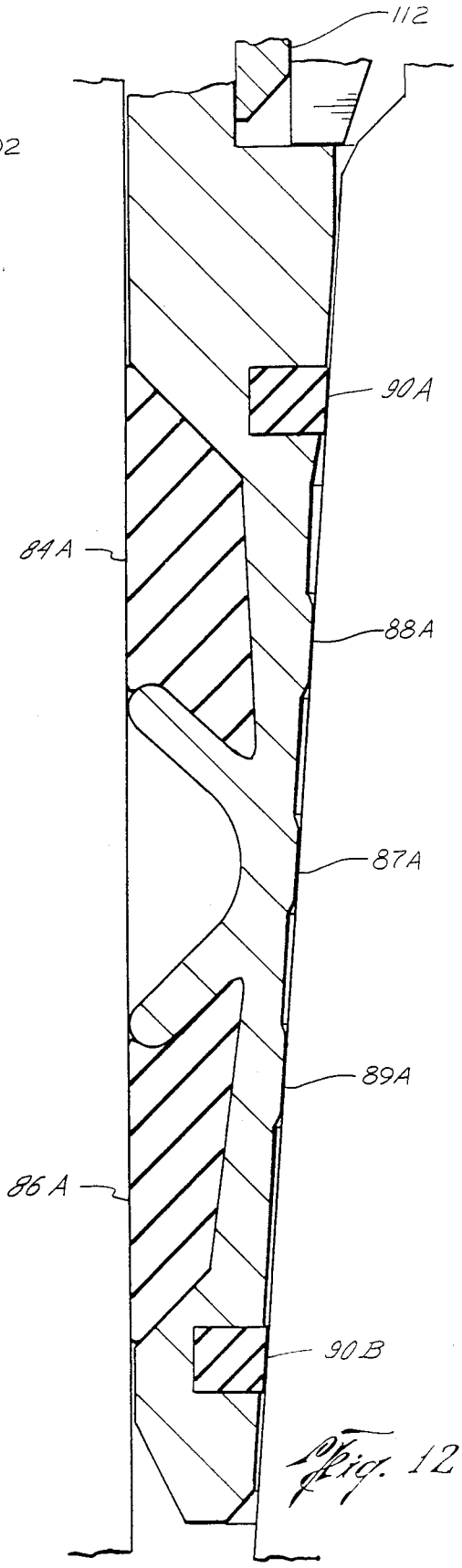
Figure 15:
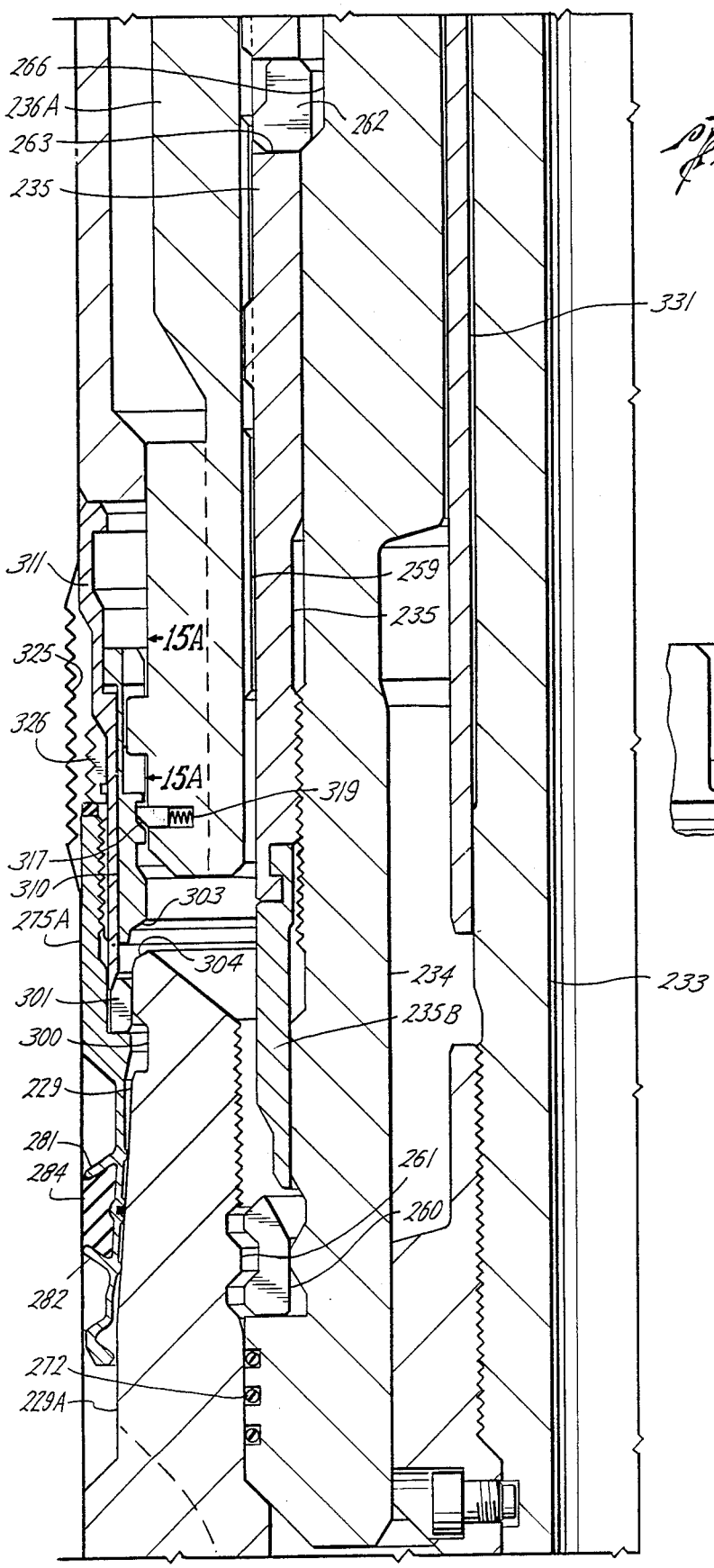
Figure 15A:
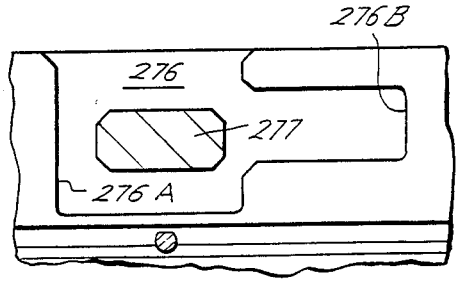
Figure 16:
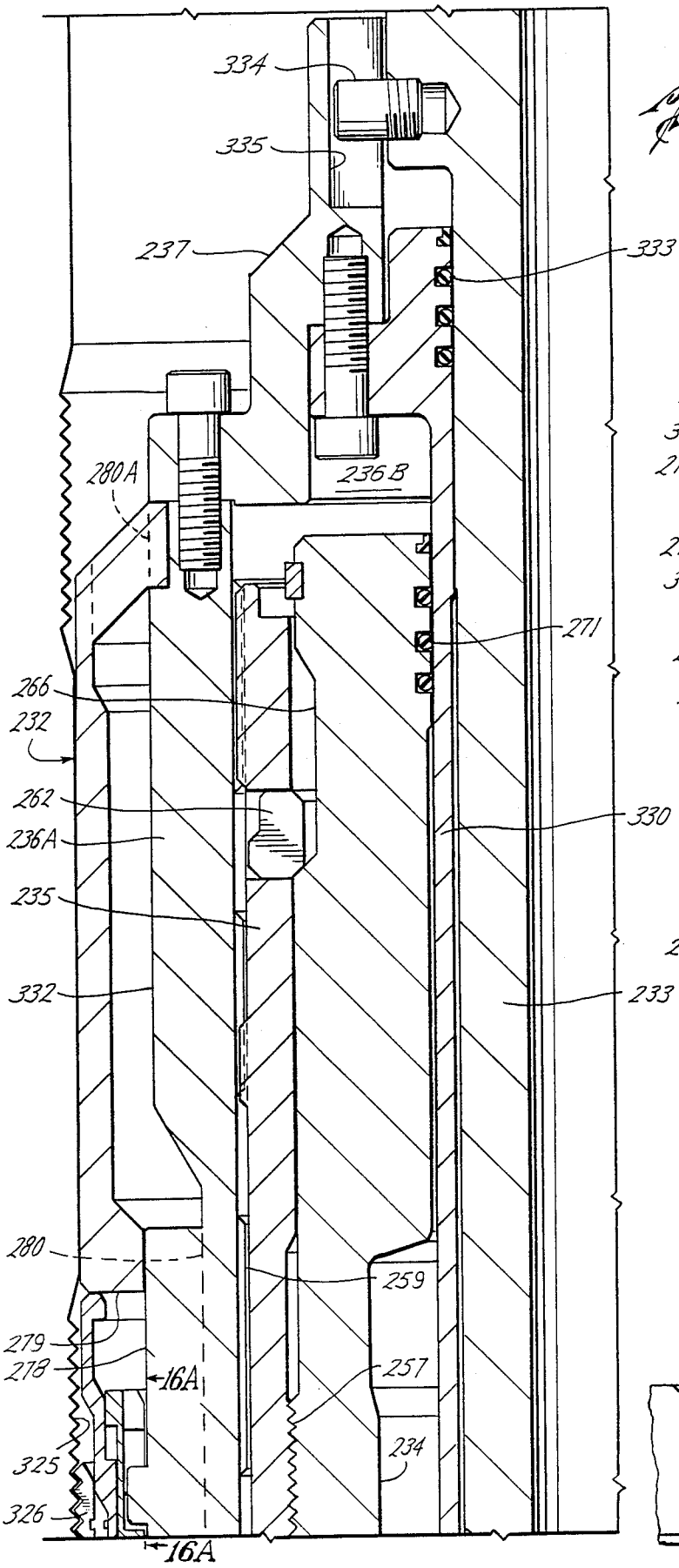
Figure 17:
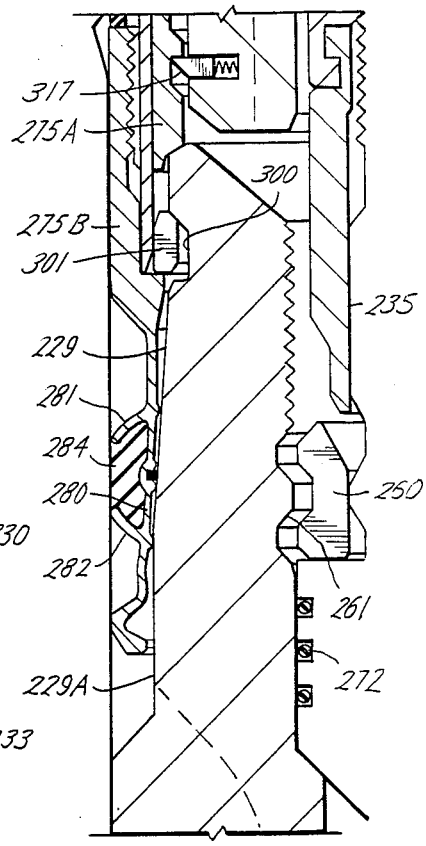
Figure 16A:
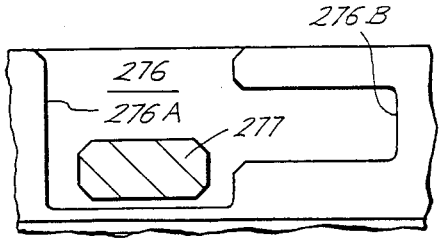
Figure 18:
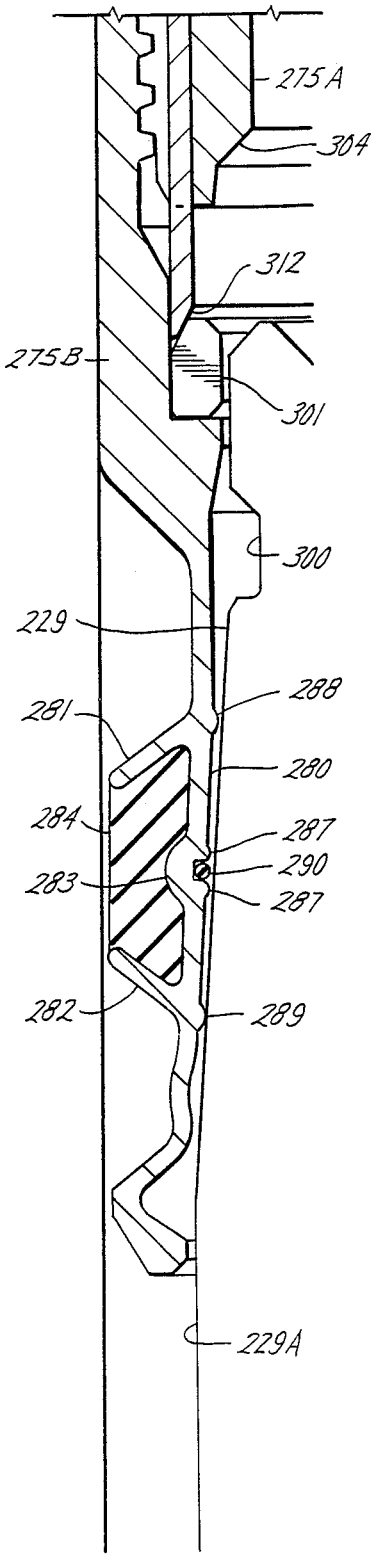
Figure 19:
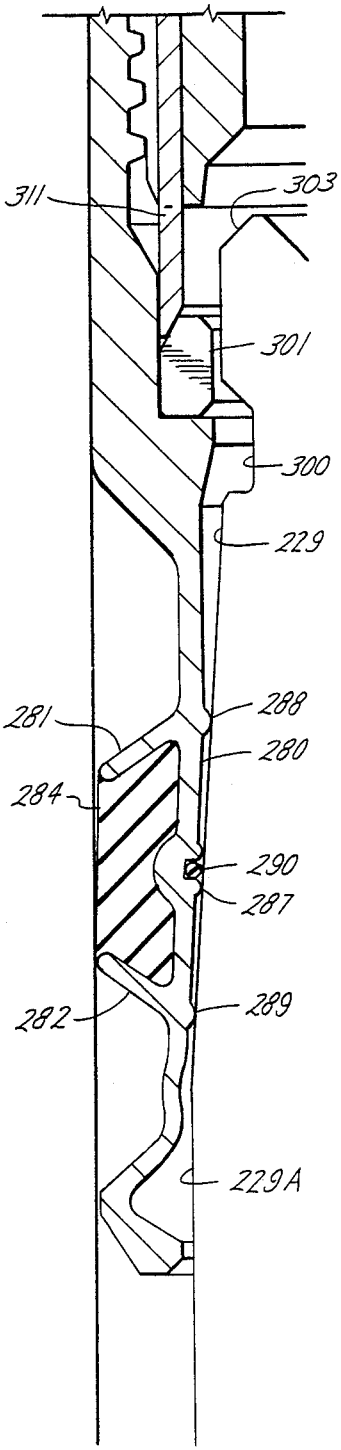
Figure 20:
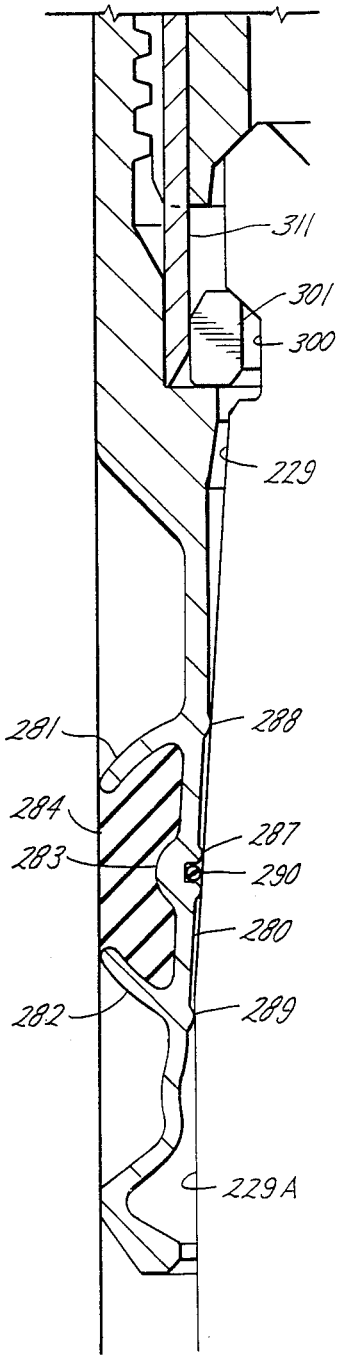
Figure 21:
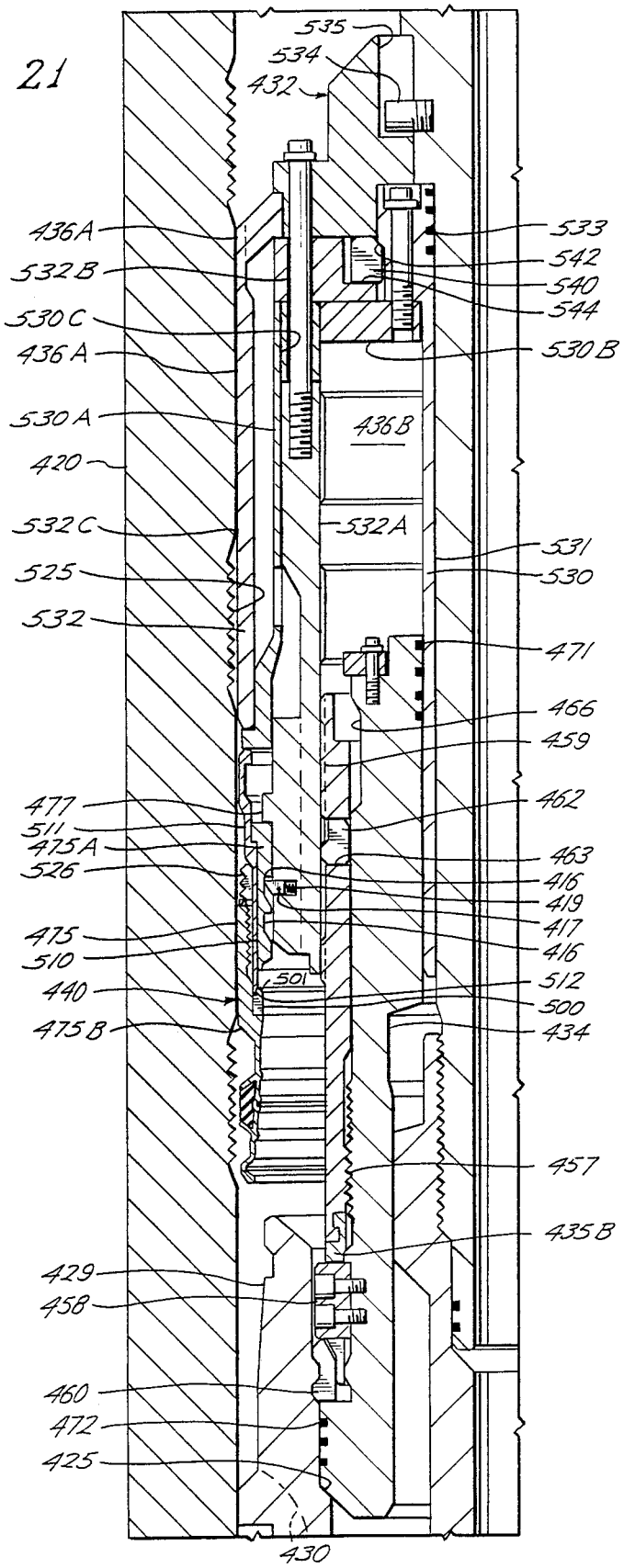
Figure 22:
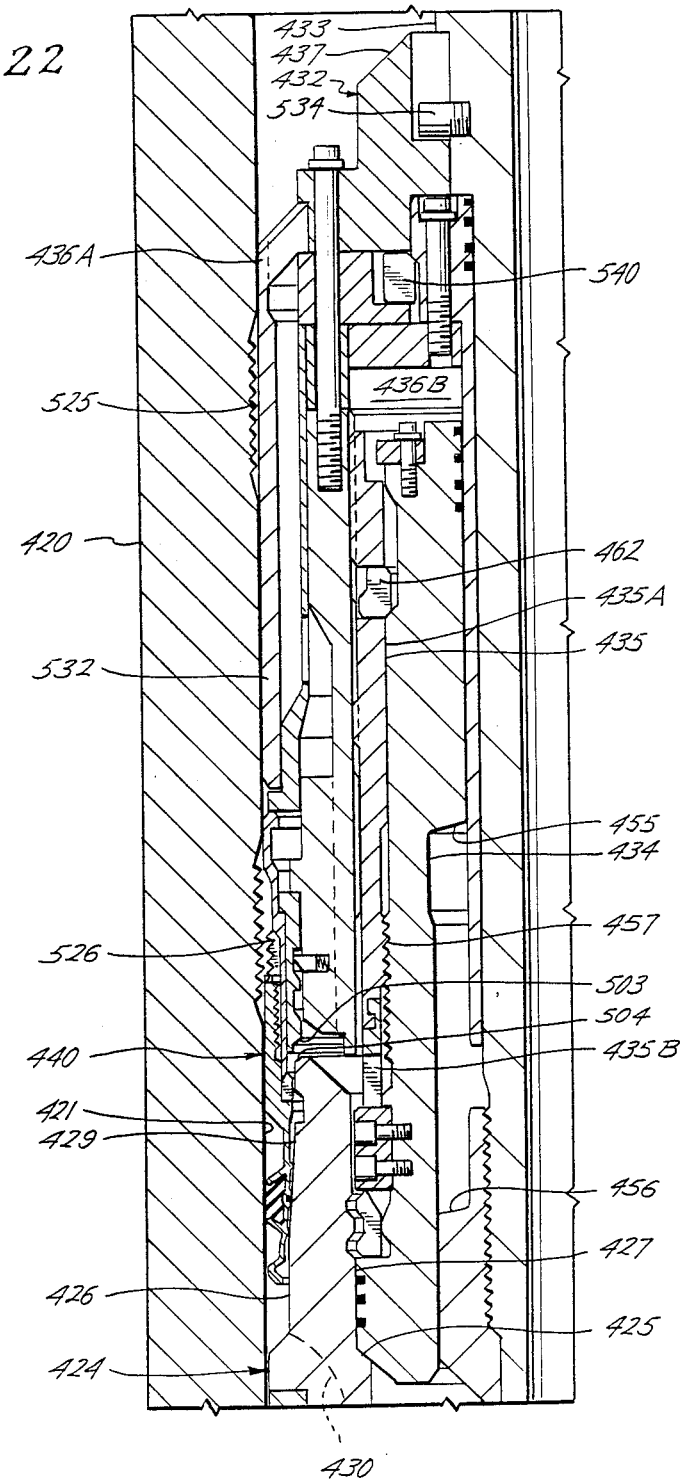
Figure 23:
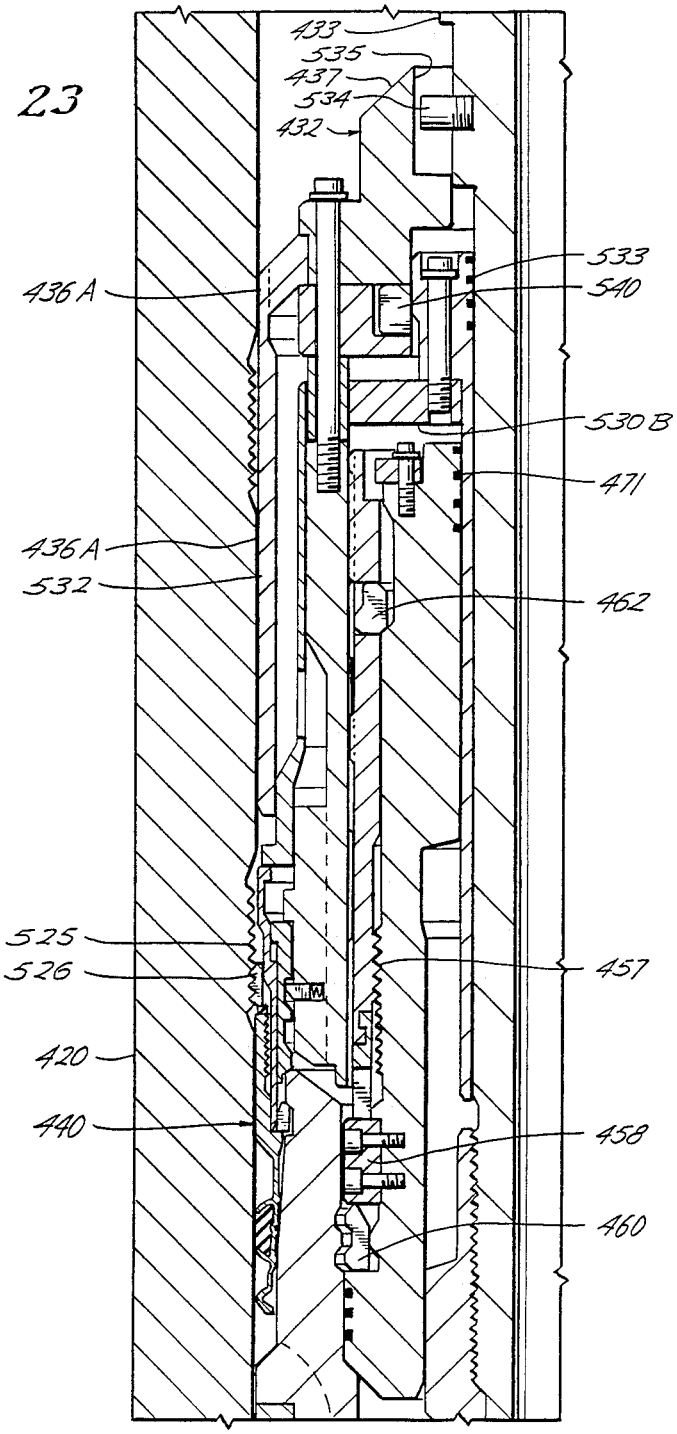

FIG. 5 is an enlarged vertical sectional view of the seal assembly and lower end of the tubular body upon lowering of the assembly into the annular space between the bore of the casing head and the outer surface of the hanger to a position in which the ribs of the inner side of the inner wall and legs on the outer side thereof sealably engage the outer hanger surface and bore of the casing head, respectively;

FIG. 5A is a further enlarged vertical sectional view of the pin and slot connection of the tubular body to the seal assembly, as seen along broken lines 5A—5A of FIG. 5;

FIG. 6 is a further enlarged vertical sectional view of the tubular body of the running tool and seal assembly, similar to FIG. 5, but upon further lowering of the seal assembly in response to weight or fluid pressure, or both, to a fully landed position on the hanger in which a locking ring carried thereby is opposite a locking groove about the hanger;

FIG. 7 is another enlarged partial vertical sectional view similar to FIG. 6, but upon rotation and lowering of the tubular body of the running tool to lower a locking sleeve of the seal assembly into a position holding the locking ring in the groove of the hanger to lock the seal assembly down with respect to the hanger, and to wedge a toothed ring carried by the seal assembly into a position engaged with grooves about the bore to hold the hanger and seal assembly down with respect to the head;

FIG. 7A is a further enlarged vertical sectional view of the pin and slot connection of the tubular body and seal assembly, similar to FIG. 5A, but as seen along broken lines 7A—7A of FIG. 7;

FIG. 8 is a vertical sectional view similar to FIG. 7, but upon raising of the tubular body of the running tool to release the body from connection to the seal assembly;

FIG. 8A is a further enlarged vertical sectional view of the pin and slot connection, similar to FIGS. 5A and 7A, but as seen along broken lines 8—8A of FIG. 8, FIG. 9 is a detailed sectional view of the lower end of the seal assembly of FIGS. 1 to 8, as it is lowered to the position of FIG. 5;

FIG. 10 is a view similar to FIG. 9, but upon lowering of the seal assembly to the position of FIG. 7;

FIGS. 11 and 12 are detailed sectional views of a seal assembly constructed in accordance with an alternative embodiment and occupying, respectively, the positions of the seal assembly shown in FIGS. 9 and 10;

FIGS. 13A and 13B are half vertical sectional views of a hanger, seal assembly and running tool constructed in accordance with a modified form of the present invention, following movement of the support ring into supported position within the groove about the bore of the head, and landing of the main body of the hanger on the seat;

FIG. 14 is a half vertical sectional view of the hanger, seal assembly and running tool, similar to but on a larger scale than FIGS. 13A and 13B, upon rotation of the mandrel of the running tool to release the tubular body of the running tool from the sleeve and lowering of the seal assembly with the body into the annular space between the bore of the casing head and outer surface of the hanger to a position in whcih ribs on the inner side of the inner wall of the seal assembly and a lower leg on the outer side thereof are respectively engaged weith the outer surface of the hanger and bore of the head;

FIG. 14A is a further enlarged vertical sectional view of a pin and slot connection between the tubular body and seal assembly, as seen along broken lines 14A—14A of FIG. 14;

FIG. 15 is a view of the hanger, seal assembly and running tool, similar to FIG. 14, but upon rotation of the mandrel of the running tool to remove the pin from a lateral portion of the slot to permit the tubular body to drop a short distance with respect to the seal assembly;

FIG. 15A is a vertical sectional view of the pin and slot connection, similar to FIG. 14A and as seen along broken lines 15A—15A of FIG. 15, to show the pin in the position it occupies to permit the tubular body to drop upon rotation;

FIGS. 16 and 17 are vertical sectional views of upper and lower ends of the seal assembly and running tool, similar to FIG. 15, but upon the supply of test pressure to the annular space about the running tool following closing of blowout preventer rams about the drill pipe to further lower the seal assembly in the space and to lower a locking sleeve or actuator body into a position in which it holds a locking ring carried by the seal assembly in a groove about the hanger;

FIG. 16A is a vertical sectional view similar to FIG. 15A, and as seen along broken lines 16A—16A of FIG. 16, to show the pin in the position it occupies upon lowering of the locking sleeve;

FIG. 18 is a further enlarged view of the lower end of the seal assembly of FIGS. 13 to 17 as it is being lowered into the space about the hanger;

FIG. 19 is a view similar to FIG. 18, but upon further lowering of the seal assembly due to weight as shown in FIG. 14, FIG. 20 is a view similar to FIG. 19, but upon closing of the rams and the supply of test pressure to further lower the seal assembly and lock it down within the space, as shown in FIG. 17;

FIG. 21 is a half vertical sectional view of portions of a hanger, seal assembly and running tool constructed in accordance with a further form of the invention, and upon landing of hanger but with the seal assembly supported by the tubular body of the running tool above the space between the outer surface of the hanger and the bore of the casing head;

FIG. 22 is a view similar to FIG. 21, but upon rotation of the mandrel of the running from connection to the hanger and release of the support of the tubular body permit the seal assembly to be lowered with the body into the space; and;

FIG. 23 is a view similar to FIG. 22, but upon the application of test fluid to the space below rams closed about the drill pipe to which the mandrel is connected to pressure energize the seal assembly and to act over piston means on a portion of the tubular body in order to lower it with respect to another portion connected to the seal assembly and thereby move the locking parts carried by the body of the assembly into a groove about the hanger.

With reference now with details of the first described form of the invention shown in FIGS. 1 to 12, a casing head, which is designated in its entirety by reference character 20, is shown to have a bore 21 therethrough and an upwardly facing seat 22 about the bore. As previously described, the casing head is normally installed at the subsea floor with its lower end connected to an outermost casing 23 which extends downwardly from the casing head into the well bore. The upper end of the casing head is adapted for connection to a blowout preventer stack (not shown) which in turn is connected to a riser pipe which extends to the surface and through which the equipment to be described may be raised and lowered during the drilling and completion of the well.

A casing hanger 24 is adapted to be lowered into and landed on the seat 22 about the bore 21 of the casing head, and an outer casing 25 is connected to its lower end for suspension within the outermost casing 23. As shown, the casing hanger 24 comprises a tubular main body 26 having a bore 27 therethrough forming an upper continuation of the outer casing 25 and a shoulder 28 thereabout for landing upon the seat 22 of the casing head. An outer surface 29 of the main body of the casing hanger above its shoulder 28 is spaced from the bore 21 of the casing head to provide an annular space AS therebetween, and slots 30 are formed in circumferentially spaced apart relation about the main body of the hanger to provide openings which, when the hanger is landed on the seat in the head, connect the annulus between the outermost casing 23 and the outer casing 25 with the annular space AS. A nut 31 is threadedly connected about a reduced diameter portion of the main body in which the slots are formed, and the shoulder 28 is formed on the lower end of the nut.

Figure 4:
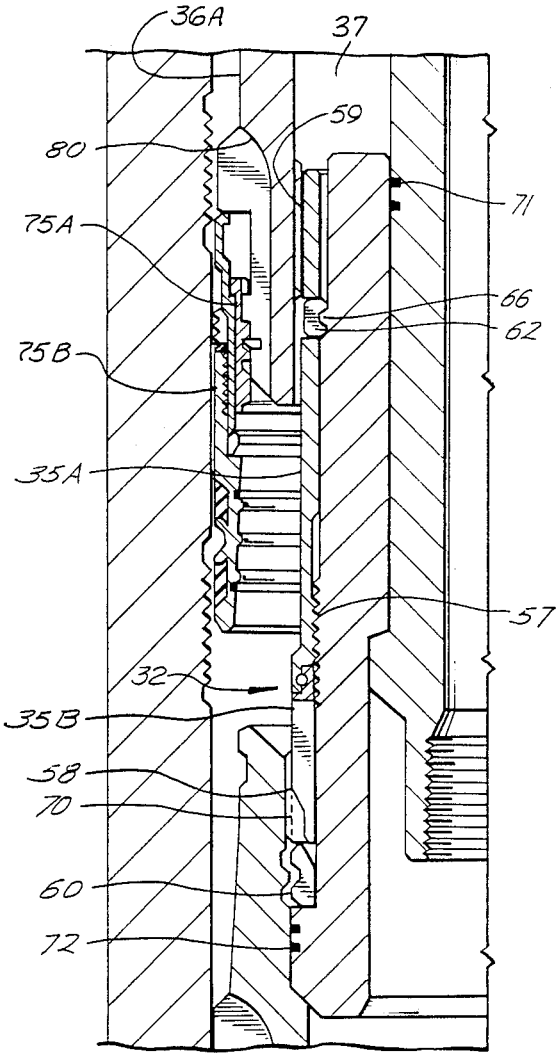
FIG. 4 is a half vertical sectional view similar to FIG. 2, but upon rotation of the mandrel of the running tool which is connected to the lower end of a drill string to release the connection of a sleeve of the running tool to the main body of the hanger and to release the support of a tubular body of the running tool which is carried by the mandrel from the sleeve.

The hanger is lowered into the casing head by means of a running tool, which is indicated in its entirety by reference character 32, and which comprises a mandrel 33 threadedly connected at its upper end to the lower end of a drill string DS (See FIG. 1A) and a tubular body 36A carried by the mandrel for rotation therewith by means of a flange 37A at its upper end to define an annular space 37 between them. The running tool also includes, a sleeve 34 which is carried by the mandrel for vertical movement with respect thereto and which is supported on a seat 25A about the bore 27 of the hanger, and a sleeve 35 which is threadedly connected about the support sleeve 34, the upper ends of the sleeves being received in the space 37 as will be described. The sleeve 35 is connected to the tubular body 36A for rotation therewith so that the mandrel may be rotated to move the sleeve 35 between a first lower position (FIGS. 1A and 2) connecting the sleeve 34 and thus the mandrel to the hanger and supporting the tubular body and thus the mandrel from the hanger, and a second upper position (FIGS. 4, 5, 7 and 8) releasing the connection of the sleeve to the hanger and the support of the tubular body 36A from the sleeve 35 (FIGS. 4 and 5).

Figure 1B:
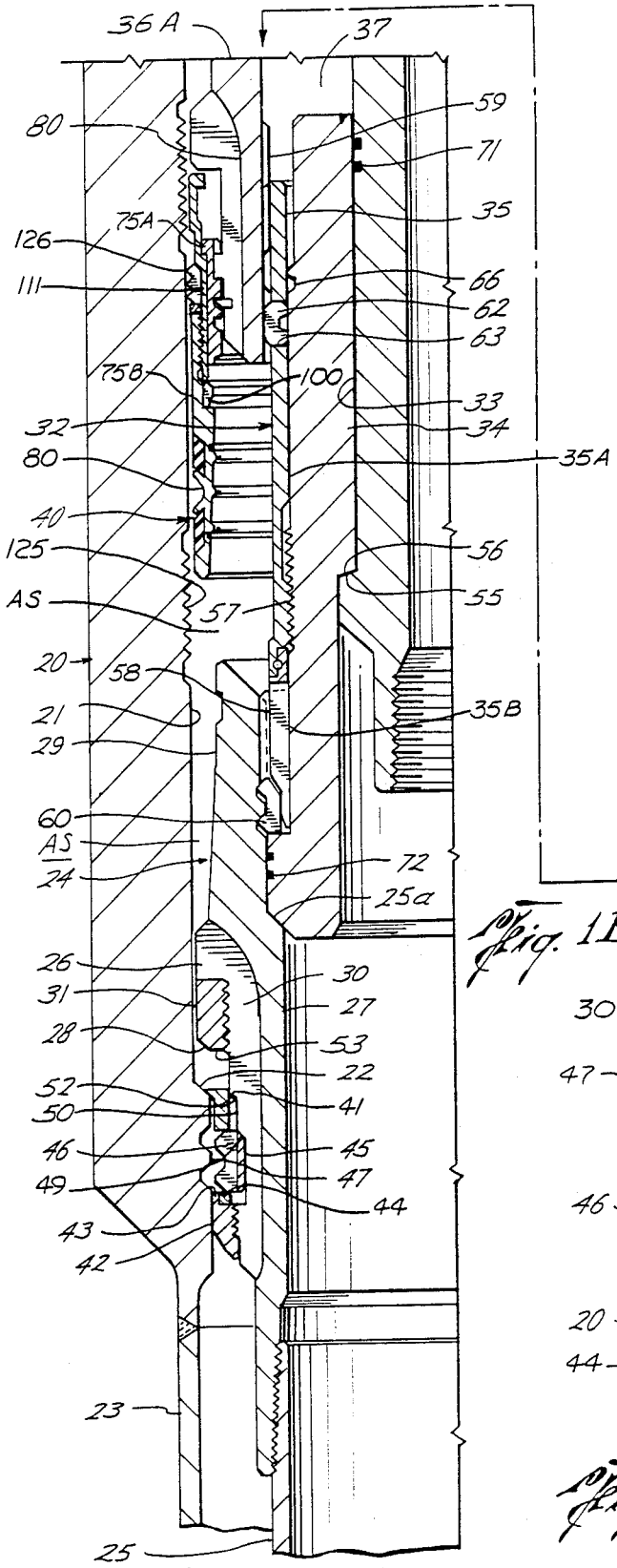
Figure 1A:
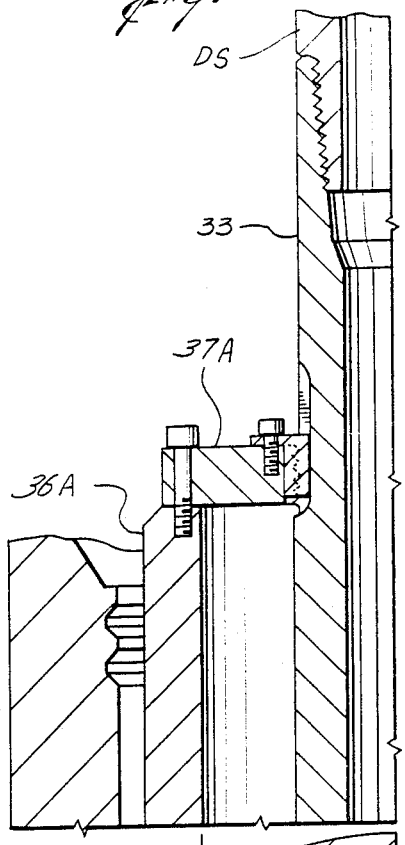
Figure 3:
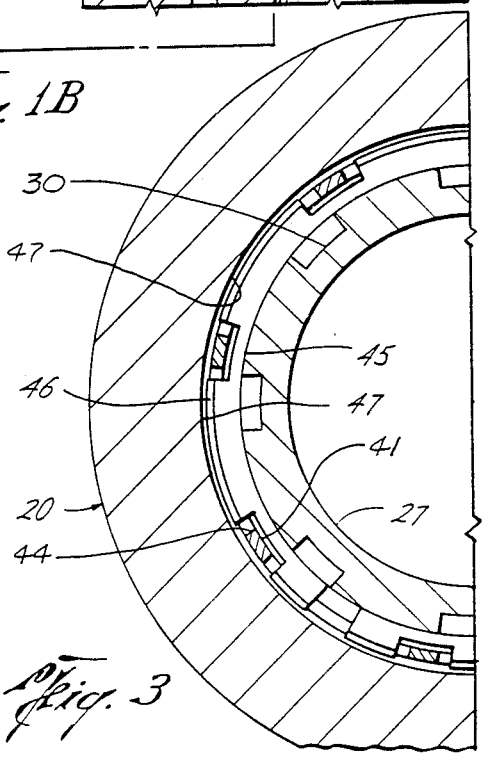
FIG. 3 is a cross-sectional view of the casing head and hanger, as seen along broken lines 3—3 of FIG. 2.

The seal assembly, which is indicated in its entirety by reference character 40, is releasably connected to the lower end of the tubular body 36A for lowering therewith from the raised position of FIG. 1B, as the running tool, hanger and seal assembly are lowered into the bore of the casing head, to the lowered position of FIG. 5, in which seal assembly has moved downwardly into the annular space and to a fully lowered position, as shown in FIG. 6, to form a metal to metal as well as a resilient seal with respect to both the hanger surface and the bore of the casing hanger. When so positioned, the seal assembly is adapted to be locked to the hanger and held against upward movement in the casing head, as will be described to follow.

The casing hanger includes, in addition to the main body 26 thereof, a carrier ring 41 which is disposed about the main body beneath the shoulder 28 thereon and which is supported by means of nut 42 connected about the lower end of the slotted portion of the main body. When the carrier ring is supported on the nut 42 it is located concentrically with respect to the main body of the hanger by means of an upwardly extending flange 43 about the nut. The carrier ring 41 has a plurality of circumferentially spaced apart openings or windows 44, and outwardly extending tooth segments 46 of a split ring 45 extend through the windows and are supported by thereby for movement between the contracted position of FIG. 1 and the expanded position of FIG. 2. When ring 45 is contracted, the tooth segments are free to move into a position opposite grooves 47 formed about the bore of the casing head beneath the seat 22, and, when expanded, they fit within the grooves and thus are supported from the head.

The split support ring 45 is of such construction that it normally assumes its contracted position so that as the hanger is lowered into the bore of the casing head, its inner diameter is engaged with a cylindrical surface 48 of the cam surface on the main body of the hanger beneath a downwardly and inwardly extending cam surface 49 on the lower end of the enlarged outer diameter portion 50 of the main body. More particularly, the upper end of the contracted support ring, is beneath the main body of the hanger, and the shoulder 28 of the main body is above the upper end of the carrier ring. As the hanger moves downwardly to the position of FIG. 1B, a shoulder 50A about the upper end of the carrier ring lands upon the seat 22 of the casing head to locate the support ring 45 with its tooth segments 46 opposite the grooves 47 in the casing head.

Since the carrier ring and thus the support ring are held against further downward movement, the weight of the drill string causes the cam surface 49 on the main body to slide over the upper end of the support ring 45 to move it into locking position within the groove 47. As the main body of the hanger moves down further to land shoulder 28 on seat 22, the enlarged diameter portion 50 about the main body of the hanger above the cam surface 49 moves downwardly within the inner diameter of the support ring 45 to hold it outwardly in locking position, and a shoulder 52 at the upper end of the portion 50 lands upon the upper end of the support ring 45 so as to transmit the downward load of the support ring to the supporting surfaces of the groove 47. At the same time, shoulder 28 on the main body lands on the seat to transmit load directly to the head, and a shoulder 53 on the lower end of main body of the hanger radially inwardly of the shoulder 28 moves downwardly to seat upon the upper end 54 of the carrier ring so as to also transmit the load of the hanger through the carrier ring and support ring to the grooves 47 in head.

Figure 2:
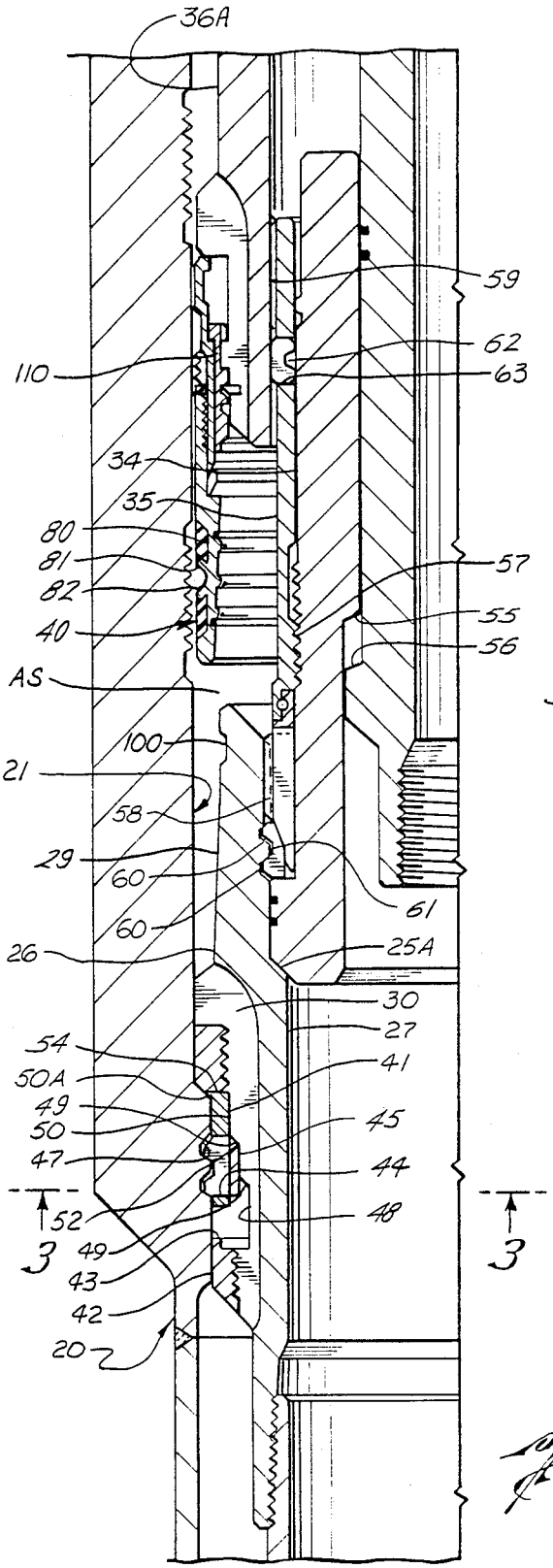
FIG. 2 is a vertical sectional view, similar to FIG. 1B, but upon continued lowering of the running tool, from the position of FIG. 1B, to land the main body of the hanger on the seat in the bore of the casing head and move a support ring supported by the carrier ring into supporting position within a groove about the bore of the casing head beneath its seat.

As previously described, sleeve 34 is carried by the mandrel of the running tool for vertical movement with respect to it. As the hanger is lowered into landed position, the sleeve is supported from the mandrel so as to depend therefrom by means of a downwardly facing shoulder 55 about the sleeve which is supported on an upwardly facing shoulder 56 about the mandrel. Thus, with the sleeve connected to the hanger, as will be described, the hanger is supported from the mandrel of the running tool for lowering into the position shown in FIG. 1B in which the carrier ring lands on the seat 22. As the mandrel of the running tool continues to be lowered, the main body of the hanger moves downwardly to land on the seat as well as the upper end of the carrier ring, and the mandrel is lowered with respect to the sleeve, as indicated in FIG. 2. At this time, however, seal assembly 40 is still in a raised position with respect to the annular space AS.

The drill string and thus the mandrel of the running tool are then rotated to raise locking sleeve 35 with respect to the sleeve 34 to release the connection of the sleeve 35 to the hanger and the support of the tubular body of the running tool from the locking sleeve, as shown in FIG. 4, whereby the seal assembly may be moved downwardly with the tubular body into the annular space, as shown in FIG. 5. For this purpose, the upper end 35A of sleeve 35 is connected to the sleeve 34 by threads 57, and the lower end 35B thereof, which is rotatably connected to the upper end, slides vertically between lugs 58 on the sleeve 34 which have a splined connection to the bore of the hanger. More particularly, in its first lower position with respect to sleeve 34, as shown in FIGS. 1B and 2, locking sleeve 35 is connected to the tubular body 36A by splines 59 for vertical movement, without rotation, with respect thereto, so that rotation of the tubular body through the mandrel and drill string will cause the sleeve 35 to move upwardly with respect to the sleeve 34 from the position of FIG. 2 to the position of FIG. 4.

Raising as the sleeve 35 lifts its lower end from within a split ring 60 having teeth thereabout adapted to fit within locking grooves 61 formed about the bore of the hanger beneath spline lugs 58. Thus, the ring 60 is of such construction that it normally assumes its contracted position, as shown in FIG. 4, in which is withdrawn into a reduced outer diameter portion of the sleeve 34 beneath the lugs thereon. At the same time, segments 62 which are mounted for radial movement within holes 63 in the sleeve 35 are raised with the sleeve to a position opposite a groove 66 about the upper end of the sleeve 34. When moved outwardly within the groove, the segments release the tubular body 36A of the running tool for movement downwardly with respect thereto and thus with respect to the sleeve 34 and the hanger. That is, the portion of the spline 59 formed on the inner side of the outer wall of the tubular body which was supported by the locking segments, following lowering of the mandrel from its FIG. 1B to its FIG. 2 position, is now free to move down past the outer sides of the locking segments.

Thus, the segments 62 are of a radial thickness which is greater than the thickness of the sleeve 35 so as to permit them to be moved radially between the alternate positions shown. When the sleeve 35 is in its lower position in which it holds the split ring 60 within the groove 61 so as to connect the sleeve to the hanger, the segments are disposed below the groove 66 and about the outer diameter of the sleeve 34 so as to be held in their outer positions to engage the lower portion of spline 59 formed on the tubular body. As previously noted, the sleeve 35 is comprised of upper and lower relatively rotatable parts 35A and 35B, with the threads 57 being formed on the upper portion 35A and with the segments 62 being carried by and legs on the lower portion 35B extending downwardly through slots 70 formed between the lugs 58. As will also be apparent from the drawings, the lugs 58 are spaced above the lower end of the reduced diameter portion of the sleeve 34 so as to receive the split ring 60 for expansion and contraction between its locked and unlocked positions.

Seal rings 71 are carried about the outer diameter of the mandrel so as to form a sliding seal with the inner diameter of the sleeve 34 during relative vertical movement between them. Seal rings 72 are carried about the outer diameter of the lower end of sleeve 34 for sealably engaging the bore of the hanger above the seat 25. Consequently, when the seal assembly 40 is lowered into sealing engagement with the bore and the hanger, as will be described in detail in connection with FIGS. 9 and 10, and rams of the blowout preventor stack (now shown) above the casing head are closed about the drill string from which the mandrel of the running tool is suspended, test pressure admitted to the space below the rams acts over the upper end of the seal assembly to urge it downwardly. Since the sealing engagement of the rams will normally prevent the drill pipe from lowering, a slip joint or vertical lost motion connection (not shown) may be provided in the mandrel 33 above the flange 37A, whereby the seal assembly may nevertheless move downwardly with the due to the force of pressure fluid acting across it, to the position of FIG. 6.

The seal assembly 40 includes a body 75 made up of upper and lower threadedly parts 75A and 75B. The lower part 75B includes an inner wall 80 which is adapted to be lowered into the annular space 50 as to seal with respect to the bore of the casing head and the annular surface 29 about the hanger, and the upper body part 75A is releasably connectible to the lower end of the tubular body of the running tool. For this latter purpose, a slot 76 is formed on the inner diameter of the upper end of seal assembly part 75A, and a lug 77 is formed on the outer diameter of a recessed portion 78 of the outer diameter of the tubular body beneath a downwardly facing shoulder 79 thereon. As indicated at 80, slots are formed within the outer wall of the body 36A so as to facilitate the flow of cement returns past the seal assembly when the seal assembly is raised and casing 25 is being cemented in the well bore.

As best shown in FIGS. 5A, 7A, and 8A, the slot 76 includes a first portion 76A which extends downwardly from the upper end of seal assembly part 75A, and a portion 76B which extends laterally from the portion 76A intermediate its upper and lower ends. More particularly, the portion 76B is of a height to closely receive the lug 77 whereby, with the tubular body in the rotative position shown, the lug 77 is positioned within the slot portion 76B so as to raise or lower the seal assembly with the tubular body. This is of course the position which the lug occupies as the seal assembly is lowered with the mandrel into the annular space, as shown in FIG. 5.

In the event it is found that the seal assembly does not hold pressure, when in its FIG. 6 position, the seal assembly may be lifted from the hanger upon raising of the running tool since the lug 77 is still in slot position 76B. In this connection, and as previously noted, the sleeve 34 of the running tool has been disconnected from the hanger so that it is free to be raised with the mandrel from the hanger. Then, as the mandrel is raised with respect to the sleeve, shoulder 56 on the mandrel engages 55 of the sleeve to lift it therewith. If the seal assembly does hold pressure, the mandrel and thus the tubular body may be rotated to the left (looking down), following withdrawal of the preventer rams, to move the lug 77 out of the slot portion 76B and into the portion 76A, as shown in FIG. 7A, whereby the mandrel may be moved downwardly to lower it with respect to the seal assembly in order to lock the seal assembly to the hanger and then upwardly therefrom to permit the running tool to be retrieved.

As previously described, the outer surface 79 of the hanger above its shoulder is tapered upwardly and inwardly at a small angle, perhaps four degrees, with respect to the vertical. The inner side of the inner wall of the lower part 75B of the body of the seal assembly is similarly tapered so that it is generally parallel to the surface 79 as the seal assembly is lowered into the annular space AS. As previously described, and upper and lower legs 81 and 82 extend from the outer side of the wall 80, with the upper leg extending upwardly and outwardly with respect to the horizontal, and the lower leg 82 extending downwardly and outwardly with respect thereto.

A recess 83 is formed in the lower body part of the seal assembly above the leg 81 to receive an annular seal ring 84, and a recess 85 is formed therein below the leg 82 to receive an annular seal ring 86 therein. As best shown in FIG. 9, each of the seal rings substantially fills its recess with its outer surface being substantially aligned with the outer sides of upper and lower enlarged ends of the lower body part 75B of the seal assembly body above and below the recesses. The outer ends of the legs 81 and 82, on the other hand, are spaced a short distance inwardly. In any event, as the assembly is lowered into the annular space as to cause the inner side of the wall 80 to engage the surface 29 of the hanger as shown in FIG. 9, these surfaces are out of engagement with the bore of the casing head.

A first rib 87 is formed about the inner side of the wall 80 generally intermediate the legs 81 and 82, and second and third ribs 88 and 89 are formed about the inner side of the wall 80 above and below the rib 87. As the seal assembly moves downwardly within the space, rib 87 is forced outwardly so as to cause the inner wall 80 to flex outwardly and permit the ribs 88 and 89 to move into engagement with surface 29. Continued lowering of the seal assembly moves the outer ends of the legs 81 and 82 and the outer sides of the seal rings 84 and 86 into engagement with the bore of the casing head, and urges the ribs 88 and 89 more tightly against the surface 29 of the hanger. Finally, the legs 81 and 82 are caused to flex upwardly and downwardly, respectively, about the connection of their inner ends to the inner wall 80 to provide a very tight metal to metal contact between the outer ends of the legs 81 and 82 in the bore of the casing head and between the ribs 88 and 89 and the surface 29 of the hanger and to compress the seal rings into tighter engagement with the bore of the casing head.

Seal rings 90 and 91 are carried within grooves about the inner side of the wall 80 in position to be moved into tight sealing engagement with the surface 29, as shown in FIG. 10, as the inner wall is flexed outwardly to cause the upper and lower ends of the inner wall to flex inwardly about the ribs 88 and 89. Thus, the seal assembly is caused to form a tight resilient back-up seal for the metal to metal seal with respect to both the bore and the casing hanger. In addition, and as will be understood from FIG. 10, due to the arrangement of the legs 81 and 82 and the sealing rings on the inner side of the wall 80, fluid pressure from above the seal assembly will urge the leg 81 and the rib 88 into even tighter engagement with the bore and the hanger, and fluid pressure from below the seal assembly will urge the leg 82 and the rib 89 into even tighter engagement with the bore and surface 29 of the hanger. This is not only useful in providing a tighter seal, but also in insuring that the seal rings 84 and 86 are not extruded downwardly past the leg 81 or upwardly past the leg 82.

The embodiment of the seal assembly shown in FIGS. 11 and 12, and indicated in its entirety by reference character 40A, is substantially identical to the seal assembly 40 except with respect to the placement of seal rings about the inner side of the lower body part of the seal assembly. Thus, in the case of the seal assembly 40A, seal rings 90A and 90B are carried within grooves formed about the inner wall of the lower body portion of the seal assembly respectively above and below the inner wall 80A. In any event, each of the seal rings 90A and 90B are disposed above and below the ribs 88A and 89A so as to back up the metal to metal seal provided by the ribs and to be in position for swinging outwardly into tight sealing engagement with the wall 29 of the casing hanger.

A groove 100 is formed about the surface 29 of the hanger near its upper end, and a split locking ring 101 is supported on a shoulder 102 about the inner side of the body 75 of the seal assembly in a position for disposal opposite the groove when the seal assembly has been moved downwardly as far as possible, as shown in FIG.

6. A shoulder 103 is formed about the lower end of the upper portion 75A of the body above the ring 101 for engaging a shoulder 104 on the upper end of the hanger above the locking groove 100 to limit downward movement of the seal assembly.

The upper portion 75A of the seal assembly body has vertical slots 110 formed in its inner side adjacent to its threaded connection to the upper end of the lower body portion 75B. The lower ends of a locking sleeve or actuator body 111 extend downwardly through the slots to dispose a tapered edge 112 thereon adjacent to the upper tapered outer edge of the locking ring 101. Thus, upon lowering of the locking sleeve 111 to the position shown in FIG. 7, the locking ring 101, which is normally expanded outwardly to unlocking position, is forced inwardly into the groove 100 to lock the seal assembly down with respect to the hanger.

When the lug 76 on the mandrel is disposed within the slot portion 76B to support the seal assembly from the mandrel, as shown in FIG. 5A, the actuator body or locking sleeve 111 is held up in the position shown in FIG. 5 by the outwardly expanded locking ring 101 with its upper end 114 disposed just beneath the shoulder 79 about the tubular body of the running tool. In order to lower the locking sleeve 111 to its locking position, the mandrel and thus the tubular body are rotated with respect to the seal assembly to move the lug 77 into the portion 74A of the slot, and thus permit the tubular body to be lowered downwardly, as the lug 77 move downwardly within the lower end of slot portion 74A, in order to move sleeve 111 downwardly from its FIG. 6 position to its locking position as shown in FIG. 7. The tubular body is of course free to be rotated with respect to the sleeves 34 and 35, as well as with respect to the hanger, by virtue of the fact that the portions of the spline 59 formed thereon are below the portions thereof formed on the sleeve 35.

Grooves 115 and 116 are formed about the inner side of the body portion 75A of the seal assembly beneath the slot therein, and a shear pin 117 is mounted in the outer side of the mandrel for moving into one of the grooves depending on the relative vertical position of the tubular body 36A with respect to the seal assembly. Thus, when the body is in the position of FIG. 6, wherein it is held by lug 77 against vertical movement with respect to the seal assembly, shear pin 117 is urged by spring 119 into the upper groove 115. However, the lower side of the shear pin is tapered so that when the tubular body is rotated and then lowered to move the locking sleeve 111 downwardly into locking position, the shear pin 117 is retracted and moved downwardly into a position into the groove 116. If the locking ring has not moved to locking position, the shear pin will permit the seal assembly to be raised with the running tool. On the other hand, if it has moved to locked position, raising of the running tool will shear pin 117 to permit the running tool to be retrieved from the seal assembly and hanger.

If it is desired to remove the seal assembly from within the annular space AS, following retrieval of the running tool, a suitable tool may be lowered into the bore of the casing head for engaging and lifting upwardly on the upper end 114 of the locking sleeve so as to raise it upwardly to the position shown in FIG. 6 wherein the locking ring 101 is free to move outwardly to expanded position. At this time, an upwardly facing shoulder 118 about the inner side of the sleeve 111 will engage a downwardly facing shoulder 119 about the upper body portion of the seal assembly opposite the lug 77, so that the seal assembly may be lifted along with the locking sleeve.

A series of horizontal grooves 125 are formed about the bore of the casing head generally opposite the upper end of the seal assembly when the seal assembly is in its lowermost position. A split ring 126 is carried about the upper end of the lower body portion 75B and has teeth about its outer side of generally the same configuration and disposed opposite the grooves 125. More particularly, the upper tapered end 127 of the ring 126 is beneath a downwardly tapered shoulder 128 on the outer side of the locking sleeve 111, so that, upon lowering of the locking sleeve to its locking position, the ring 126 is urged outwardly to engage its teeth with the grooves 125. More importantly, there are sufficient grooves 125 to permit the teeth on the ring 126 to engage therewith at several relative vertical positions between the seal assembly and the bore, thereby enabling the hanger and seal assembly to be held down against vertical movement with respect to the bore despite vertical tolerances.

It is contemplated that the teeth on the ring will not be moved fully into the grooves 125, but instead will be moved only a short distance into the grooves to engage their peaks beneath those of the grooves. A rubber ring 130 is disposed between the lower end of the ring 126 and the upper end of the body portion 75B so as to permit the teeth to engage the grooves in the event, even though unlikely, that their peaks are opposite one another.

The hanger and seal assembly are initially assembled on the running tool as shown in FIG. 1B to permit the carrier ring of the hanger to be lowered onto the seat 22 of the casing head. Then, as weight is slacked off on the running tool, the mandrel and thus the sleeve 34 supported by it may be moved further downwardly to expand the support ring 45 into the groove 47 in the bore of the casing head beneath its seat 22 and lower the lower end 53 of the nut to be lowered onto the upper end of the landed carrier ring. Thus, the portion of spline 59 on the outer wall of the tubular body of the running tool moves down from the position of FIG. 1B to that of FIG. 2 to engage and then lower the segments 63, which in turn lowers sleeves 35 and 34 to lower the hanger. This of course causes shoulder 56 on the mandrel to drop below shoulder 55, as shown in FIG. 2.

After the casing 25 has been cemented in the well bore, the drill string and thus the running tool may be rotated in a right hand direction so as to raise the sleeve 35 to release the connection of the sleeve 34 to the hanger, and further to release the tubular body from supported position on the sleeve 35, as shown in FIG. 4. At this time, the body 36A may be moved downwardly to lower the seal assembly 40 into the annular space AS, as shown in FIG. 5, following which additional weight imposed on the running tool forces the seal assembly further downwardly. The rams of the blowout preventer are then closed to permit fluid pressure to force the seal assembly down to its lowermost position, as shown in FIG. 6. In addition to pressure energizing the seal assembly, this also enables the seal assembly to be pressure tested, so that if it does not hold pressure, it may be retrieved along with the running tool from the hanger which is locked down within the head.

Assuming that the seal assembly, when fully lowered, holds pressure, the drill string is rotated to the left so as to move the lug 77 into the position shown in FIG. 7A with respect to the slot 76 in the seal assembly, and the tubular body is then lowered into the lower end of the slot portion 76A, so as to lower the locking sleeve 111 to lock the seal assembly to the hanger. At the same time, the ring 126 is forced outwardly to engage its teeth with the grooves 125 about the bore of the casing head to hold the hanger and seal assembly down against upward movement with respect to the head. Assuming that the sleeve is so lowered, the operator may retrieve the running tool merely be lifting it so as to cause the lug 77 to move upwardly through the open upper end of the slot portion 76A, as shown in FIG. 8A.

As will be apparent from FIGS. 13 to 20 of the drawings, and the detailed description to follow, the form of hanger, seal assembly and running tool shown therein is similar in many respects to that described in connection with FIGS. 1 to 12. Thus, many of its parts corresponding to those of the prior form are identified by reference characters differing from those of the prior form by the addition of two hundred. Thus, for example, as described in connection with the form of the invention shown in FIGS. 1 to 12, a casing head 220 having a bore 221 therethrough and a seat 222 about the bore is normally installed at the subsea floor with its lower end connected to an outer most casing 223 extending downwardly from the casing head into the well bore. The upper end of the casing head, on the other hand, is adapted to be connected to a blowout preventer stack (not shown) connected to a riser pipe extending to the surface, and through which the hanger and seal assembly to be described are raised and lowered during the completion of the well.

A hanger 224 is shown in FIG. 13B to be landed upon the seat 222 within the bore of the casing head and locked within the bore so as to suspend an outer casing 225 connected to its lower end within the outer most casing 223. The casing hanger 224 comprises a tubular main body 226 having a bore 227 therethrough which forms an upper continuation of the outer casing 225, and a shoulder 228 about the main body of the hanger is landed upon the seat 222 of the casing head. The outer surfacce 229 of the main body of the hanger above its shoulder 228 is spaced from the bore 221 of the casing head to provide an annular space between them, and slots 230 formed about the main body connect the annulus between the outer most casing 223 and the outer casing 225 with the annular space. A nut 231 threadedly connected about a reduced diameter portion of the main body in which the slots are formed provides the shoulder 228 which is landed on the seat 222.

The hanger 224 is lowered into landed position and locked therein by means of a running tool indicated its entirety by reference character 232. As in the case of the running tool of the previously described form of the invention, the running tool 232 comprises a mandrel 233 which is run on the lower end of a drill string DS (FIG. 13A) and which is releasably connected to the hanger in a manner to be described.

As in the case of the previously described form of the invention, the casing hanger 224 includes, in addition to the main body 226, a carrier ring 241 which is disposed about a reduced outer diameter portion of the main body beneath its shoulder 228 and which, as it is lowered within the bore of the casing head, is supported from the main body by means of ring 242 carried about the main body. Thus, as shown in FIG. 13B, the ring 242 is supported by a snap ring 242A to dispose a shoulder about its bore beneath a shoulder 242B on the main body. When supported on the ring 242, the carrier ring 241 is held in a concentric position with respect to that main body of the hanger by means of a flange 243 on the upper end of the ring 242.

The carrier ring 241 has a plurality of circumferentially spaced apart openings or windows 244 to receive outwardly extending segments 246 of a split ring 245 for movement between a contracted position, as the hanger is lowered into space, and an expanded position within grooves 247 formed about the bore of the casing head beneath the seat so as to support the ring 241 from the casing head when the hanger has been lowered to a position in which the segments 246 are opposite the grooves.

As in the previously described form of the invention, the split support ring 245 is of such construction that it normally assumes its contracted position, so that as the hanger is lowered into the bore of the casing head, the inner diameter portions of the support ring fit within recessed cylindrical surfaces 248 of the main body of the hanger beneath downwardly and inwardly extending cam surfaces 249 beneath enlarged portions 250 of the main body. As the hanger is lowered to the position of FIG. 13B, a shoulder 250A about the upper end of the carrier ring lands upon the seat 222 of the casing head to locate the support ring with its tooth segments 246 opposite the grooves 247. The weight of the drill string is then slacked off to cause the cam surfaces 249 on the main body to slide over the upper ends of radially reduced portions of the support ring so as to move the support ring into the locking position. As the main body of the hanger moves down further to land its shoulder 228 on seat 222, the enlarged diameter portions 250 about the main body above the cam surfaces 249 moves downwardly within the radially reduced portions of the support ring to hold the support ring in locking position, and a shoulder 252 at the upper end of the reduced portions 250 lands upon the upper end of the support ring 245, and a shoulder 253 on the nut lands on the upper end 254 of the carrier ring, so as to transmit the downward load of the support ring to the supporting surfaces of the grooves 247.

The running tool 232 also includes a tubular body 236A which is connected to the mandrel for rotation therewith by means of a flange 237 to form an annular space 236B beneath them. The running tool also includes a first sleeve 234 carried by the mandrel for vertical movement with respect to it and supported on a seat 225A about the bore 227 of the hanger, and a second sleeve 235 which is threaded at 257 about the support sleeve 234 for vertical movement with respect to it. More particularly, the sleeve 235 is connected with the tubular body 236A by a spline 259, and sleeve 234 is held against rotation with respect to the hanger, so that the mandrel and thus the tubular body may be rotated to move sleeve 235 between a first lower position, as shown in FIG. 13B, in which it connects the sleeve 234 to the hanger and supports the tubular body from the hanger, and a second position wherein it releases the connection of the sleeve to the hanger and the support of the tubular body 236A from the sleeve 235. Thus, the seal assembly 240 is releasably connected to the lower end of the tubular body 236A so that, with the hanger landed and locked within the bore of the casing head, as shown in FIG. 13B, the seal assembly may be lowered from the raised position of FIG. 13B with the tubular body into the space between the hanger and bore of the head shown in FIG. 14.

As the hanger is lowered into landed position, sleeve 234 is supported from the mandrel and tubular body of the running tool so as to depend therefrom by means of a downwardly facing shoulder 255 about the sleeve supported on an upwardly facing shoulder 256 about the mandrel. Thus, with the sleeve connected to the hanger, as shown in FIG. 13B, and as will be described, the hanger is supported from the mandrel of the running tool for lowering into a position in which the carrier ring 241 lands on the seat 222. Then, as the mandrel of the running tool continues to be lowered, the main body of the hanger moves downwardly to land on the seat, as previously described and as shown in FIG. 13B.

The drill string and thus the mandrel of the running tool are then rotated to raise the locking sleeve 235 with respect to the support sleeve 234 so as to release the connection of the sleeve 235 to the hanger and the support of the tubular body 236A from the locking sleeve, whereby the seal assembly may be lowered with the tubular body into the annular between the tubing hanger and the bore of the casing head. For this purpose, and in much the same manner described in connection with the form of the invention shown in FIGS. 1 to 12, the upper end 235A of the sleeve 235 is connected to the sleeve 234 by threads 257, and the lower end 235B thereof, which is rotatably connected to the upper end 235A, slides vertically between lugs 258 on the sleeve 234 which are splined to the bore of the hanger. More particularly, in its first lower position with respect to the sleeve 234, as shown in FIG. 13B, locking sleeve 235 is connected to the tubular body 236A by splines 259 for vertical movement without rotation with respect thereto. Thus, rotation of the body of the running tool through the drill string will cause the sleeve 235 to move upwardly with respect to the sleeve 234 from the position of FIG. 13B to the position of FIG. 14.

Raising of the sleeve 235 lifts its lower end from within a split ring 260 having teeth thereabout adapted to fit within locking grooves 261 formed about the bore of the hanger beneath the splines in which the lugs are received. The ring 260 is supported on a shoulder about sleeve 234 and is of such construction that it normally assumes its contracted position, as shown in FIG. 14, in which it is withdrawn into a reduced outer diameter portion of the sleeve 234 beneath the lugs 258. At the same time, lugs 262 which are mounted for radial movement within holes 263 in the sleeve 235 are raised with the sleeve to a position opposite a groove 266 about the upper end of the sleeve 234. Upon movement outwardly within the groove, the lugs are removed from the lower end of the splines 259 to release the tubular body 236A of the running tool for movement downwardly with respect thereto and thus with respect to the sleeve 234 and the hanger. At this time, of course, the seal assembly is moved downwardly into the annular space upon slacking off of the weight of the running tool.

The tubular body 236A of the running tool includes a first outer tubular portion 332 to which the seal assembly 240 is releasably connected, and a seond inner tubular portion 330 which is bolted to portion 332 for rotation and vertical movement therewith. Seal rings 271 are carried about the inner diameter of the sleeve 234 so as to seal with respect to the outer diameter of the inner tubular portion 330 of the tubular body 236A, and seal rings 331 are carried by the inner diameter of portion 330 to seal with respect to the outer diameter of mandrel 233.

Seal rings 272 are carried about the outer diameter of the lower end of sleeve 234 for sealably engaging the bore of the hanger above the seal 225, so that, when the seal assembly 240 is lowered into sealing engagement with the bore of the casing head and the hanger, and the rams of the blowout preventer stack above the casing head are closed about the drill string from which the mandrel of the running tool is suspended, test pressure admitted to the space below the rams acts over the seal assembly to urge it further downwardly. More particularly, and as will be described to follow, this test fluid is not only useful in further energizing and testing the seal assembly, but also, in this form of the invention, in locking the seal assembly to the hanger.

The seal assembly 240 is similar to the seal assembly of the previously described form of the invention in that it also includes a body 275 made up of upper and lower threadedly connected parts 275A and 275B. The lower part 275B is lowered into the annular space so as to seal with respect to the bore of the casing head and the annular surface 229 about the hanger, and the upper part 275A is releasably connectible to the tubular body 236A of the running tool. For this latter purpose, a slot 276 is formed on the inner diameter of the upper end of the seal assembly part 275, and a lug 277 is formed on the outer diameter of a recessed portion of the outer diameter of the body beneath a downwardly facing shoulders thereon. One difference between the form of the invention now being described and the previously described form, is that the tubular body of the running tool comprises inner and outer tubular members 278 and 279 connected to one another for vertical movement together, and forming an annular space between them providing an upper continuation of slots 280 formed in the inner member 278. Additional slots 280A are formed in the upper end of the outer tubular member 279 to form an upward continuation of the annular space for cement returns between the members 278 and 279. The lugs 277 are formed on the inner diameter of inner tubular member 278, and the outer tubular member 279 has the shoulder on its lower end raised above the lugs, for purposes to be described to follow. As shown, the outer member is rotatable with respect to the outer member so that it serves to center the seal assembly.

As best shown in FIGS. 14A, 15A and 16A, the slot 276 includes a first portion 276A which extends downwardly from the open upper end of the slot at the upper end of the seal assembly part 275A, and a portion 276B which extends laterally from the portion 276A intermediate its upper and lower ends. More particularly, the portion 276B is of height to closely receive the lug 277. Thus, with the tubular body in rotative position shown in FIG. 14, the lug is positioned within the slot portion 276B so as to raise or lower the seal assembly with the body. When the lug is rotated to the left (looking down), the lug 277 is moved out of the slot portion 276B and into the portion 276A, in which position the body may be moved upwardly from within the slot or downwardly with respect to the seal assembly, so as to land on the lower end of the slot portion 276A, as shown in FIG. 14A.

As previously described, and as in the form of the invention shown in FIGS. 1 to 12, the outer surface 229 of the hanger body above its shoulder is tapered upwardly and inwardly at a small angle with respect to the vertical, and the lower portion 275B of the body of the seal assembly includes an inner wall 280 whose inner side is similarly tapered so that it is generally parallel to the surface 279 as the seal assembly is lowered into the annular space. More particularly, the body part 275B of the seal assembly is similar to the corresponding part of the seal assembly of the prior described form in that it includes upper and lower legs 281 and 282 which extend from the outer side of the wall 280. However, and as compared with the previously described form of the invention, the upper leg extends downwardly and outwardly and the lower leg extends upwardly and outwardly with respect thereto. Thus, the legs form a recess 283 between them, and an annular seal ring 284 is received within and substantially fills the recess with its outer surface protruding slightly from the outer ends of the legs 281 and 282 and being substantially vertically aligned with the outer sides of the metal body at both ends of the inner wall.

A rib 287 having closely spaced apart rib sections is formed about the inner side of the wall 280 generally intermediate the intersection with the wall 280 of the legs 281 and 282. Upper and lower ribs 288 and 289, respectively, are formed about the inner side of the wall 280 above and below the rib 287, the upper rib 288 being generally laterally opposite the intersection of the leg 281 with the wall 280 and the lower rib 288 being generally laterally opposite the inner section of the leg 282 with the inner wall 280.

As the seal assembly is lowered into the annular space, as shown in FIG. 18, the rib 289 engages with the surface 279 on the main body of the casing hanger and, as weight is slacked off on the running tool, slides downwardly over the surface 279 so as to force the outer end of the rib 282 into engagement with the bore of the casing head. As about the same time, the ribs 287 have moved further downwardly to cause the portion of wall 280 on which they are formed to flex outwardly and thereby move the central portion of the seal ring 284 toward the bore of the casing head. Toward the end of this further downward movement of the seal assembly, the upper rib 288 moves into engagement with the tapered surface 279, although due to the inclination of the tapered surface, the outer end of the leg 281 opposite rib 288 has not engaged the bore of the casing head. A seal ring 290 is carried within the annular recess between the center rib sections 287. The outer surface of this seal ring as well as the outer surface of the lower portion of the seal ring 284 which protrudes from the legs 281 and 282, respectively, have formed initial contact with the tapered surface 279 and the bore of the casing head.

Upon further downward movement of the seal assembly, the rib 288 is moved radially outwardly to cause the outer end of leg 281 to engage the bore of the casing head. At the same time, the continued radially outward movement of the rib 289 will cause the lower leg 282 to distort upwardly and inwardly as shown in FIG. 20. During the final downward movement of the seal assembly, the lower rib 289 moves into a cylindrical surface 229A about the tubing hanger and beneath tapered surface 229, so that the force on the lower leg 282 is relieved as the upper rib 288 continues to move radially outwardly to cause the upper leg to 281 to be flexed downwardly. As in the case of the seal assemblies previously described, the ribs on the inner side of the wall 280 and the outer ends of the legs 281 and 282 form a tight metal-to-metal seal between the tubing hanger and the bore of the casing head which is backed up by the resilient seals.

This form of the seal assembly is believed to be especially useful in maintaining a seal between the hanger and bore of the casing head even in the event pressure within the well cycles upwardly and downwardly. Thus, since the legs 281 and 282 are vertically spaced from one another, they act independently with respect to upwardly or downwardly directed pressure forces. Furthermore, both of the seal rings 284 and 290 are trapped by the outer ends of the legs and intermediate ribs which form metal-to-metal seals with respect to the surfaces of the bore of the casing head and the casing hanger.

As in the previously described form of the invention, a groove 300 is formed about the surface of the main body of the hanger near its upper end, and a split locking ring 301 is supported on a shoulder about the inner side of the lower metal body part of the seal assembly in a position for disposal opposite the groove 300. A shoulder 303 is formed about the lower end of the upper portion 275A of the metal body of the seal assembly above the ring 301 for engaging a shoulder 304 on the upper end of the hanger above the groove 300 to limit downward movement of the seal assembly with respect to the hanger and thereby locate ring 301 opposite the groove 300 when the seal assembly has been moved downwardly to its set position.

The upper portion of the seal assembly body has vertical slots 310 formed on its outer side adjacent its threaded connection to the upper end of the lower body portion 275B. The lower end of an actuator body or locking sleeve 311 extends downwardly through the slots to dispose a tapered lower end 312 thereof adjacent to an upper tapered outer edge of the locking ring 301. Thus, upon lowering of the locking sleeve to the position of FIG. 17, the normally expanded locking ring 301 is forced inwardly into the groove 300 to lock the seal assembly down with respect to the hanger.

When the lug 277 on the tubular body of the running tool is disposed within the slot portion 276B to support the seal assembly from the mandrel, the locking sleeve 311 is held by the expanded locking ring 301 in its raised position to dispose its upper end just beneath the shoulder about the outer wall of the tubular body of the running tool, as shown in FIG. 14. In order to lower the locking sleeve 311 to the locking position of FIG. 17, the mandrel and thus the tubular body are rotated with respect to the seal assembly to move the lug 277 into the portion 276 of the slot, whereby the body may be lowered with respect to the running tool as the lug 277 moves downwardly within the vertical portion of the slot. As noted in connection with the previously described form of the invention, the tubular body is free to be rotated with respect to the sleeves 234 and 235, as well as with respect to the hanger, since the portions of the spline 259 form on thereon are below the portions formed on the sleeve 235.

As was also true of the previously described form of the invention, grooves are formed about the inner side of the body part 275A of the seal assembly beneath the slot 276, and a shear pin 317 is carried within the outer side of the tubular body for moving into and out of one of the grooves 316 depending on the relative vertical position of the body with respect to the seal assembly. The shear pin is urged outwardly by means of a spring 319 and functions with respect to the grooves in the same manner described in the previous form of the invention. The seal assembly may also be removed from the annular space, following retrieval of the running tool, in the manner described in connection with the previous form of the invention.

A series of horizontal grooves 325 are formed about the bore of the casing head generally opposite the upper end of the seal assembly when the seal assembly is in its lower most position. Also, a split ring 326 is carried about the upper end of the lower body portion 275B and has teeth about its outer side of generally the same configuration and disposed opposite the grooves 325. More particularly, and as in the previously described form of the invention, the upper tapered end of the split ring 326 is beneath a downwardly tapered shoulder on the outer side of the locking sleeve 311, so that, upon lowering of the locking sleeve to its locking position, the ring 326 is urged outwardly to engage its teeth with the grooves 325. Other details of the construction of the ring and its relationship to the groove 325 as well as the disposal of a rubber ring beneath the lower end of the ring 326 have been described in connection with the previous form of the invention, and thus it need not be repeated herein.

The running tool of the form of the invention described in connection with FIGS. 13 to 20 differs from that of the previously described form in that the lower reduced end of the inner tubular body portion 330 thereof provides a piston 331 which, together with the outer tubular body portion 332, is urged downwardly by test pressure. The flange 237 and thus the piston are held against rotation with respect to the mandrel by means of a pin 334 on the mandrel slidable within a vertical slot 335 formed in the upper end of the flange. The piston slides within an annular space between the mandrel 233 and sleeve 234 which has a relatively small cross sectional area defined between the seal rings 271 and 333 over which test fluid is effective to urge the tubular body downwardly. Downward movement of the piston and body with respect to the mandrel is limited by engagement of the lower end of the piston with a shoulder 337 formed about the outer diameter of the tubular body of the mandrel above the shoulder 256 thereon.

As previously described, and as compared with the manipulation of the running tool of the first described form of the invention, the mandrel is rotated to move the lug 277 out of the slot portion 275B prior to the closing of blowout preventor rams about the drill pipe and the supply of test fluid to the space therebelow. When the mandrel has been so rotated, the lug is free to drop a short distance with respect to the seal assembly, as shown by a comparison of FIGS. 14A and 15A, whereby the lower tapered end of the locking sleeve 311 is moved downwardly due to engagement of the shoulder about the outer part of the tubular body with the upper end of the locking sleeve. Thus, the lower tapered end of the locking sleeve will wedge the locking ring 301 against the outer diameter of the upper end of the hanger, as shown in FIG. 15.

When the rams are closed about the drill pipe and test pressure is applied to the space beneath them, it acts over the cross-sectional area of the piston to lower the tubular body 236A of the running tool, and thus the locking sleeve 311, from the portion of FIG. 15 to that of FIGS. 16 and 17 to move the locking ring 301 outwardly into the groove 300 and hold it in the groove, as can be seen from FIG. 17. At the same time, the pressure of the test fluid is effective over the cross sectional area of the seal assembly to urge it further downwardly within the annular space, and thereby permit the locking ring to move into a position opposite the groove 300. As previously described, since the seal assembly is locked to the hanger at the same time that it is pressure energized, accidental lifting of the running tool will not unseat the seal assembly, and thus run the risk of having the operator accidently pull the seal assembly from the well bore with the running tool. If, on the other hand, the running tool is accidently pulled up before test pressure is supplied to the space beneath the rams, the operator need only lower it back to its original position. Also, of course, although the force of the piston and thus its cross-sectional area need not be large since only a small amount of additional force may be required to set the seal assembly.

With the exceptions noted above regarding the procedure for applying test pressure to the space beneath the rams,—i.e., rotation of the mandrel from the tubular member to disconnect the seal assembly prior to the application of this test pressure,—the procedure for operating this form of the invention is the same as that described in connection with the previous form, and hence need not be repeated herein.

Many of the parts of the form of the invention shown in FIGS. 21, 22 and 23 which correspond to parts of the form shown and described in connection with FIGS. 13 to 20 have been assigned the same reference characters except for the addition of 200. Thus, for example, a casing head 420 having a bore 421 therethrough is installed at the subsea floor with its lower end (not shown) connected to an outer casing extending downwardly from the casing head into the well bore. As in the prior described forms of the invention, the upper end of the casing head is adapted to be connected to a blowout preventer stack (not shown) connected in turn to a riser pipe extending to the surface, and through which the hanger and seal assembly to be described are raised and lowered during completion of the well.

A hanger 424 is shown in FIGS. 21, 22 and 23 to be landed upon a seat (not shown) within the bore of the casing head and locked within the bore, as described in connection with the prior form of the invention, so as to suspend an outer casing (not shown) connected to the lower end of the hanger within the outermost casing to which the casing head is connected. As in the prior described forms of the invention, the hanger 424 includes a tubular main body 426 having a bore 427 therethrough which forms an upper continuation of the outer casing suspended from the hanger, and an outer surface 429 which is spaced from the bore 421 of the casing head to provide an annular space between them, with slots 430 being formed about the main body to connect the annulus between the outermost and outer casing with the annular space.

The hanger 424 has been lowered into landed position within the head and then locked therein by means of a running tool indicated in its entirety by reference character 432. As in the case of the previously described form of the invention, the running tool 432 comprises a mandrel 433 which is run on the lower end of a drill string DS, and a tubular body 436A which is carried by the mandrel for rotation therewith by means of a flange 437 to form an annular space 436B between the mandrel and tubular body and which is releasably connected to a seal assembly 440 for lowering it into an annular space between the hanger and bore of the head. The running tool 432 is similar to the previously described running tools in that it includes a first sleeve 434 carried by the mandrel for vertical movement with respect to it and releasably connected to the hanger to lower it into landed and locked position within the bore of the casing head, and a second sleeve 435 which is threaded about the support sleeve 434 for vertical movement with respect to it. More particularly, and again as described in the connection of the previous form of the invention, the sleeve 235 is connected for rotation with and axial movement with respect to the tubular body 436A, so that, upon rotation of the mandrel and thus the tubular body, the sleeve 435 may be moved between a first lower position, in which sleeve 234 is held connected to the hanger and in which sleeve 235 supports the tubular body 436A and thus to the mandrel as shown in FIG. 21, and a second upper position, as shown in FIG. 22 wherein the connection of the sleeve to the hanger and the support of the tubular body from the sleeve 235 is removed. Thus, the weight of the drill string may be slacked off to lower the tubular body with respect to the sleeve 235 and the hanger and thus lower the seal assembly into the annular space, as shown in FIG. 22.

As in the previously described forms of the invention, sleeve 434 is supported from the mandrel 433 of the running tool so as to depend therefrom, as the hanger is lowered toward landed position, by means of a downwardly facing shoulder 456 about the mandrel engageable with an upwardly facing shoulder 456 on the mandrel. Then, as the hanger is landed and locked in the bore of the head, the tubular body and thus the mandrel more downwardly to the position of FIG. 21, and then, as the tubular body is released from its support on the sleeve, and the seal assembly is lowered therewith into the annular space, the mandrel is lowered further with respect to the hanger, as shown in FIG. 22.

Again, as in the previously described forms of the invention, the sleeve 435 has an upper end 435A which is connected to the sleeve 434 by threads 457, and a lower end 435B which is rotatably connected to the upper end and which slides vertically between lugs 458 on the sleeve 434 which are splined to the hanger. More particularly, in its first lower position with respect to the sleeve 434, as shown in FIG. 21, locking sleeve 435 is connected to the tubular body 436A by splines 459 for vertical movement without rotation with respect thereto. Thus, rotation of the tubular body of the running tool causes the sleeve 435 to be moved upwardly with respect to the sleeve 434 from the position of FIG. 21 to the position of FIG. 22.

In its lower position, sleeve 435 fits within a split ring 460 having teeth thereabout to force fit the teeth into locking grooves formed about the bore of the hanger beneath the splines in which the lugs 458 are received. As in the previously described forms of the invention, the ring 460 is supported on a shoulder about the sleeve 434 and is of such construction that it normally assumes its contracted position, when the lower end 435B of sleeve 435 is removed from its inner diameter, as shown in FIG. 22, so as release the connection of sleeve 434 to the hanger. Lugs 462 are mounted for radial movement within holes 463 in the sleeve 435, and thus in position to support the tubular body 436A as they are raised with the sleeve to a position opposite a groove 466 about the upper end of the sleeve 434. When moved outwardly within the groove, the lugs are removed from the lower end of the splines 459 to release the tubular body 436A of the running tool for movement downwardly with respect thereto and thus with respect to the sleeves and the hanger.

Seal rings 471 are carried about the inner diameter of the sleeve 434 so as to seal with respect to the outer diameter of an inner tubular member of a tubular portion 530 of the tubular body 436A and seal rings 533 are carried by the inner diameter of the tubular member to seal with respect to the outer diameter of the mandrel 433. More particularly, and as will be described to follow, the tubular member provides a piston 531 which is vertically reciprocated in the annular space between sleeves 434, so that the seal rings 471 and 533 form sliding seals therewith during such reciprocation. Seal rings 472 are carried about the outer diameter of the lower end of the sleeve 434 for sealably engaging the bore of the hanger above the seat 425 therein, so that when the seal assembly 440 is lowered into sealing engagement with the bore of the casing head and hanger, as shown in FIG. 22, and the rams of the blowout preventer stack are closed about the drill string, test fluid admitted to the space below the rams acts over the seal assembly to urge further downwardly. As in the prior described invention, and as will be explained to follow, this pressure is not only useful in further energizing and testing the seal assembly, but also in locking the seal assembly to the hanger.

The seal assembly 440 is quite similar to the seal assembly of the previously described form of the invention in that it includes a body 475 made up of upper and lower threadedly connected parts 475A and 475B. Thus, as in the prior described forms of the invention, its lower end is adapted to slide downward within and seal with respect to an upwardly and inwardly tapered surface 429 of the hanger and a cylindrical surface of the bore of the head. In fact, and as shown, the lower body part 475B of the seal assembly is identical to that of the seal assembly of the prior described form of the invention. The upper body part 475A is, however, different from the corresponding body part of the running tool of the previously described form of the invention in the manner in which it is connected to and released from the tubular body 436A of the running tool. Hence, a lug 477 on the tubular body of the running tool merely engages the upper end of the upper body part 475A to move the seal assembly downwardly therewith, and the body part is supported from the tubular body for lowering therewith by a shear pin 417 which is carried within a hole in the outer side of the tubular body for moving into and out of groove 416 formed about the body part 475A of the seal assembly. The shear pin is urged outwardly by means of a spring 419 and thus supports the seal assembly until sheared, following locking of the seal assembly to the hanger, by lifting of the running tool to permit its retrieval.

Thus, as previously mentioned, the body part 475A does not have a slot from which the lug must be removed because the running tool is of such construction it is not necessary to rotate the running tool in order to release it from the seal assembly in the retrieval of the running tool.

As in the previously described form of the invention, a groove 500 is formed about the outer surface 429 of the main body of the hanger, and a split locking ring 501 is supported on a shoulder about the inner side of the lower body part 475B of the seal assembly in a position for disposal opposite the groove when the seal asembly has been lowered to the position of FIG. 22. Also, a shoulder 503 is formed about the lower end of the seal assembly body part 475A above the ring 501 for engaging a shoulder 504 on the upper end of the hanger above the groove 500, so as to limit downward movement of the seal assembly from the position of FIG. 22 to the position of FIG. 23 and thus locate the ring 501 opposite the groove 500.

Again as in the prior described form of the invention, the upper seal assembly body part has vertical slots 510 formed in its outer side adjacent its threaded connection to the upper end of the lower body part 475B, and the lower end of an actuator body or locking sleeve 511 extends downwardly through the slots to dispose tapered lower ends 512 thereof adjacent an upper and tapered outer edge of the lock ring 501. Thus, upon lowering of the locking sleeve from the position of FIG. 22 to the position of FIG. 23, in a manner to be described, the normally expanded lock ring 501 is forced into the groove 500 to lock the seal assembly down with respect to the hanger.

The running tool of this form of the invention is similar to that of the previously described form in that the piston 531 on the tubular portion 530 of the tubular body thereof is urged downwardly by test pressure thereabove. In other respects however, the running tool differs from that of the previously described form of the invention in that the tubular portion 530 and its piston 531 are vertically movable with respect to another tubular portion 532 of the tubular body which is connected to the mandrel of the running tool by means of the flange 437 for rotation therewith. More particularly, and as also previously mentioned, in the running tool of this form of the invention, the seal assembly is supported by the tubular portion 532, and the tubular portion 530 is so arranged that it lowers the locking sleeve 511 into locking position in response to the application of test fluid to the piston 531 to lower it with respect to tubular portion 532.

The shear pin 417 and the lug 477 are formed on a depending tubular member 532A of the tubular portion 532 which is supported from the flange 437 by means of bolts 532B. The flange 437 has a vertical slot 535 formed therein to receive a pin 534 on the mandrel so as to permit the flange 437 and thus the tubular member 532A of the tubular portion 532 to move vertically with respect to the mandrel without rotation. The piston 531 of the tubular body 530 is connected to an outer tubular member 530A by means of a flange 503B bolted to the upper end of the piston and having holes 530C therein which receive the bolts of 532B so as to rotate the tubular portion 530 with the tubular portion 532 while permitting relative vertical movement between them. As shown, the tubular member 530A surrounds the member 532A, and when in its upper position, as shown in FIG. 22, its lower end which extends down to a position just above the upper end of sleeve 511.

As shown, spline 459 is formed on the inner diameter of the tubular member 532A so that, in the position of FIG. 21, member 532A is supported from the sleeve 435 to hold the seal assembly above the annular space between the hanger and head. The tubular body portion 532 is rotated with the mandrel and transmits this rotation to the tubular body portion 530 through the bolts 532A. More particularly, the tubular body portion 530 is initially supported from the tubular portion 532 to hold the lower end of tubular member 530A in the position of FIG. 21 by means of a detent comprising a split ring 540 supported on a shoulder 541 of the tubular portion 532 beneath the flange 537. Thus, in its normally contracted position, as shown in FIG. 22, a tapered shoulder about the upper end of the detent ring is disposed beneath a tapered shoulder 542 about the enlarged upper end of the piston 530 so as to normally hold the upper end of the piston against the lower end of the flange 437 and a shoulder about the mandrel 433 above seal rings 533.

When the running tool has been lowered to land the hanger in the head, and then rotated it so as to release the tubular body portion 532 and thus the body portion 530 from support by the support by the sleeve 435, the weight of the drill string may be slacked off to lower the seal assembly into the annular space between the hanger and bore of the head. As shown in FIG. 22, at this time, the blowout preventer rams are closed about the drill pipe and the test fluid is introduced into the space beneath the rams so as to act over the lower end of the seal assembly sealingly engaged with the hanger and bore of the head so as to urge the seal assembly downwardly within the space so as to urge it and tubular body portion 530 downwardly. The test fluid also acts across the cross sectional area of the piston 530. Initially, however, this downward force on the tubular body portion 530A is transmitted through the detent ring 540 to the tubular body portion 532 so as to provide additional force to lower the seal assembly downwardly. This may be particularly useful if the test fluid acting over the seal assembly to pressure energize it does not fully lower it into the annular space. That is, this initial downward force transmitted to the tubular body portion 532, and to the seal assembly body through the lug 477, insures that the shoulder 503 is seated upon the shoulder 504 to dispose the locking ring 501 opposite the groove 500 in the hanger.

The force due to test fluid will then expand the detent ring 540, so as to permit the piston 531 thus and the tubular body portion 530 to move downwardly with respect to the tubular portion 532, and thus with respect to the body of the seal assembly. As a result, the lower end of the tubular member 530 forces the locking sleeve 511 downwardly to the position of FIG. 23 in order to move the locking ring 501 into locking position within the groove 500. As in the prior described forms of the invention, an expandable and contractable locking ring 526 is carried about the locking sleeve 511 beneath a tapered shoulder thereon and supported on the upper end of the lower seal assembly body part 475B. The ring 526 is thus wedged outwardly by the locking sleeve, as the sleeve moves downwardly into locking position, and thus into engagement with grooves 525 formed on the bore of the casing head, thereby not only locking the seal assembly to the hanger, but also locking the seal assembly and thus the hanger down within the head. At this time, of course, and as will be understood from the description of the prior forms of the invention, the running tool may be removed from the hanger and seal assembly merely by lifting the drill pipe so as to shear pins 417 releasably connecting the running tool to the seal assembly.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Wellhead equipment, comprising
a casing head connectible to an outermost casing string and having a bore therethrough,
a casing hanger lowerable through and landable within the bore of the head and connectible to an outer casing string for suspending it within the outermost string,
said hanger having a surface forming an annular space between it and the bore of the casing head when landed thereon,
a seal assembly for closing the space, and
a running tool including
a mandrel connectible to a drill pipe for raising and lowering therewith,
a first sleeve supported by the mandrel for vertical movement with respect thereto and supported on and sealably engaged with the hanger,
means holding the first sleeve against rotation with respect to the hanger when supported thereon,
a tubular body carried by the mandrel for rotation therewith and releasably connected to the seal assembly for lowering the seal assembly with the mandrel,
a second sleeve threadedly connected to the first sleeve and connected to the tubular body for rotation therewith and axial movement with respect thereto, in response to rotation of the mandrel, between a first position supporting the tubular body with the seal assembly above the annular space and a second position releasing the tubular body to permit the seal assembly to be lowered therewith into the annular space for sealably engaging the bore and surface of the casing hanger,
means connecting the first sleeve to the hanger, when the second sleeve is in the first position, and releasing the first sleeve from the hanger when the second sleeve is moved toward its second position, and
means for locking the seal assembly against vertical movement to permit said running tool to be raised from the seal assembly and hanger upon release of the seal assembly from connection to the tubular body.

2. Wellhead equipment of the character defined in claim 1, wherein
said means releasably connecting the first sleeve to the hanger includes
a groove about the hanger, and
means carried by the first sleeve for movement into the groove when the second sleeve is in its first position and out of the groove as the second sleeve is moved to its second position.

3. Wellhead equipment of the character defined in claim 1, wherein
the hanger has a groove thereabout, and
the seal assembly includes a body releasably connected to the tubular body of the mandrel,
locking parts carried by the seal assembly body for movement into and out of the groove, and
an actuator body carried by the seal assembly body for engagement by the tubular body and vertical movement with respect to the seal assembly body to lower the actuator body in order to move and hold the locking parts into the groove.

4. Wellhead equipment of the character defined in claim 3, wherein
the bore of the head has the vertically spaced grooves formed thereabout,
a holding ring is carried by the seal assembly body and has vertically spaced teeth thereabout for movement into and out of engagement with the grooves, and
the actuator body has means therein for moving the holding ring outwardly into engagement with the grooves for holding the seal assembly body down with respect to the bore as the actuator body is lowered to move the locking parts into the groove about the hanger.

5. Wellhead equipment of the character defined in claim 4, including
resilient means between the holding ring and the seal assembly.

6. Wellhead equipment of the character defined in claim 1, wherein
the second sleeve and tubular body are connected by a spline,
the first sleeve has a recess, and
the tubular body is releasably supported by latching segments carried by the second sleeve for lateral shifting between a position beneath the spline on the tubular body, when the second sleeve is in the first position, and a position removed from beneath the spline and disposed within the recess, when the second sleeve in its second position, whereby the spline is free to move downwardly past the segments.

7. For use with wellhead equipment which includes
a casing head connectible to an outermost casing string and having a bore therethrough,
a casing hanger lowerable through and landable within the bore of the head and connectible to an outer casing string for suspending it within the outermost string,
said hanger having a surface forming an annular space between it and the bore of the casing head when landed thereon, and
a seal assembly for closing the space and adapted to be locked to the hanger;
a running tool which comprises
a mandrel connectible to a drill pipe for raising and lowering therewith,
a first sleeve supported by the mandrel for vertical movement with respect thereto and adapted to be supported on the hanger,
said first sleeve having means engagable with the hanger for holding it against rotation with respect to the hanger when supported thereon,
a tubular body carried by the mandrel for rotation therewith and connected to the seal assembly for lowering the seal assembly with the mandrel,
a second sleeve threadedly connected to the first sleeve and connected to the tubular body for rotation therewith and axial movement with respect thereto, in response to rotation of the tubular body, between a first position supporting the tubular body with the seal assembly above the annular space and a second position releasing the tubular body to permit the seal assembly to be lowered therewith into the annular space for sealably engaging the bore and surface of the casing hanger, and means on the first sleeve for connecting it to the hanger, when the second sleeve is in the first position, and releasing the first sleeve from the hanger, when the second sleeve is moved toward its second position, the connection of said tubular body to the seal assembly being releasable to permit the running tool to be raised from the hanger and seal assembly when the seal assembly is locked to the hanger.

8. A running tool of the character defined in claim 7, wherein said means for releasably connecting the first sleeve to the hanger includes means carried by the first sleeve for movement into a groove about the hanger when the second sleeve is in its first position and out of the groove as the second sleeve is moved to its second position.

9. A running tool of the character defined in claim 7, wherein the second sleeve and tubular body are connected by a spline, the first sleeve has a recess, and the tubular body is releasably supported by the second sleeve by latching segments carried by the second sleeve for lateral shifting between a position beneath the spline on the tubular body, when the second sleeve is in the first position, and a position removed from beneath the spline and disposed within the recess when the second sleeve is int its second position, whereby the spline is free to move downwardly past the segments.

10. Wellhead equipment, comprising a casing head connectible to an outermost casing and having a bore therethrough, a casing hanger lowerable through and landable within the bore of the head and connectible to an outer casing for suspending it within the outermost casing, when so landed, said casing hanger having an outer surface which is tapered outwardly and inwardly at a relatively small angle with respect to the vertical to form a frusto-conically shaped annular space between it and a cylindrical portion of the bore of the head and openings connecting the annulus about the outer casing beneath the hanger with the annular space, a seal assembly including a metal body having a lower end whose inner side is also tapered upwardly and inwardly at a relatively small angle with respect to the vertical for sliding downwardly along the tapered surface to the hanger and which is outwardly flexible to cause its outer side to be engaged tightly against the bore of the casing head so as to close the space as the seal assembly is lowered into the space, and a running tool including a mandrel having an upper end connectible to a drill pipe for raising and lowering therewith, a sleeve supported by the mandrel for vertical movement with respect thereto, means sealing between and releasably connecting the sleeve to the hanger for lowering with the running tool into landed position, a tubular body carried by the mandrel for rotation therewith and releasably connected to the seal assembly for lowering the seal assembly with the mandrel, means connecting the tubular body to the sleeve for supporting the tubular body in an upper position with respect to the hanger to support the seal assembly above the annular space, and then, upon landing of the hanger and rotation of the tubular body with the mandrel, releasing the tubular body for lowering with respect to the hanger to lower the lower end of the seal assembly into the annular space, the tubular body being vertically movable with respect to the upper end of the mandrel, so that, with the lower end of the seal assembly lowered into the space and sealably engaging the hanger and bore of the head, blowout preventer rams may be closed about the drill pipe above the mandrel and test fluid supplied to the space therebelow to urge the seal assembly downwardly in space, and means for locking the seal assembly against vertical movement to permit the running tool to be raised from the seal assembly following release of the seal assembly from the connection to the tubular body.

11. Wellhead equipment of the character defined in claim 10, wherein said seal assembly includes rings of resilient sealing material carried about the inner and outer sides of the metal body for sealing between the body of the seal assembly and the bore of the casing head and surface of the hanger to provide back-up for the metal to metal seals therebetween.

12. Wellhead equipment of the character defined in claim 10, wherein the metal body has means on its inner and outer sides which is pressure energized by fluid pressure from above and below the seal assembly.

13. Wellhead equipment of the character defined in claim 10, wherein the tubular body has piston means thereon over which test fluid acts to urge it downwardly.

14. Wellhead equipment of the character defined in claim 10, wherein the means for locking the seal assembly against vertical movement within the head when lowered into the space, comprising locking parts carried by the seal assembly body, and an actuator body carried by the seal assembly body in position to be engaged by and lowered with the tubular body in order to move the locking parts into locking position.

15. Wellhead equipment of the character defined in claim 14, including means for connecting body of the seal assembly to the tubular body for vertical movement and rotation therewith, upon rotation of the tubular body in one direction, and for releasing the tubular body for vertical movement with respect to the seal assembly body upon rotation of the tubular body in the opposite direction with respect to the seal assembly body.

16. Wellhead equipment of the character defined in claim 15, wherein the seal assembly is lowerable with the tubular body as the tubular body is lowered with respect to the mandrel, so that, following release of the tubular body from the seal assembly body and opening of the preventer rams, the mandrel may be lowered to in turn lower the tubular body with respect to the seal assembly body in order to lower the actuator body and thereby lock the seal assembly.

17. Wellhead equipment of the character defined in claim 15, wherein the tubular body has piston means thereon over which the test fluid is effective to urge the tubular body downwardly, so that, upon release of the tubular body from the seal assembly body, test fluid will lower the actuator body to lock the seal assembly as the seal assembly body is urged downwardly.

18. Wellhead equipment of the character defined in claim 14, wherein the tubular body includes a first portion carried by the mandrel for rotation therewith and releasably connected to the body of the seal assembly to lower it therewith, and a second portion having piston means thereon over which test pressure is effective to lower said second portion with respect to said first portion, said second portion being engageable with the actuator body to lower it therewith and thereby lock the seal assembly body as test fluid acts over the seal assembly to urge it downwardly within the space.

19. Wellhead equipment of the character defined in claim 18, including detent means releasably connecting the first portion to the second portion so that the first portion is initially urged downwardly with the second portion in response to test pressure.

20. Wellhead equipment, comprising a casing head connectible to an outermost casing and having a bore therethrough with radially outer and inner, upwardly facing seating surfaces thereabout and at least one groove with an upwardly facing load supporting surface in the bore beneath the seating surfaces, a casing hanger lowerable into the bore of the casing head and including a main body connectible to an outer casing for suspending it within an outermost casing, a carrier ring supported by the main body of the hanger for vertical movement with respect thereto, and tooth segments carried by the ring in normally retracted positions for lowering with the ring into the bore beneath the seating surfaces, said ring having a shoulder thereon landable on the inner seating surface to locate the tooth segments opposite a groove, and said main body having cam means thereon which, in response to lowering of the main body with respect to the tooth segments following landing of the ring shoulder, expands said tooth segments into supported position within the groove and transmits the load of the hanger to the head through the tooth segments, and a shoulder which, upon expansion of the tooth segments, lands on the outer seating surface to transmit the load of the hanger directly to the head.

21. Wellhead equipment of the character defined in claim 20, wherein said cam means on the main body of the hanger includes a first cam surface for expanding the tooth segments into supported position, during initial lowering of said main body, and a second cam surface for transmitting the load of the hanger upon continued lowering of said main body.

22. Wellhead equipment of the character defined in claim 20, wherein said inner and outer seating surfaces are formed on a conically shaped seat in the bore of the head.

23. Wellhead equipment of the character defined in claim 20, wherein the tooth segments are joined to one another to form a split load ring.

24. Wellhead equipment of the character defined in claim 23, wherein the carrier ring has openings through which the tooth segments extend for expansion and contraction.

25. Wellhead equipment of the character defined in claim 20, wherein the main body of the hanger has a hole therethrough and a seat about the bore on which an inner casing hanger connectible to an inner casing may be landed to suspend the inner casing within the outer casing.

26. Wellhead equipment, comprising a casing head connectible to an outermost casing and having a bore therethrough a casing hanger lowerable through and having a shoulder thereabout and landable within the bore of the head and connectible to an outer casing for suspending it within the outermost casing, said casing hanger having an outer surface above its shoulder which is tapered upwardly and inwardly at a relatively small angle with respect to the vertical to form a frusto-conically shaped annular space between it and a cylindrical portion of the bore of the head and openings connecting the annulus about the outer casing beneath the hanger with the annular space, and a seal assembly lowerable into the space for closing same, said assembly including a metal body having a lower inner wall whose inner side is also tapered upwardly and inwardly at a relatively small angle with respect to the vertical and has means thereon slidable downwardly along the hanger surface to flex the wall outwardly as the assembly is lowered into the space, and vertically spaced legs extending from and surrounding the outer side of the wall, a first of the legs extending upwardly and outwardly and a second of the legs extending downwardly and outwardly from the wall at acute angles with respect to the horizontal so that the first leg is fixed upwardly and the second leg is flexed downwardly as their outer ends are forced against the bore of the casing head by outward flexing of the inner wall.

27. Wellhead equipment of the character defined in claim 26, including resilient seal means contained about the outer side of the inner wall above the first leg and below the second leg for sealably engaging the bore, and resilient seal means about the inner side of the inner wall for sealably engaging outer surface of the hanger.

28. Wellhead equipment of the character defined in claim 27, wherein the first leg is above the second leg, and the resilient seal means about the outer side of the inner wall comprises an upper seal member contained within a recess above the upper leg and a lower seal member contained within a recess below the lower leg.

29. Wellhead equipment of the character defined in claim 27, wherein the second leg is above the first leg, and the resilient seal means about the outer side of the inner wall comprises a seal member contained within a recess between the first and second legs.

30. Wellhead equipment of the character defined in claim 26, wherein the means on the inner wall slidable along the hanger surface comprises a first rib about the inner side of the inner wall generally vertically intermediate the legs.

31. Wellhead equipment of the character defined in claim 30, wherein the means on the inner wall also includes second and third ribs about the inner side of the inner wall above and below the first rib which are slidable over and forced tightly against the hanger surface as the inner wall is flexed outwardly.

32. Wellhead equipment of the character defined in claim 31, including resilient seal means about the outer side of the inner wall above the first leg and below the second leg for sealably engaging the bore, and resilient seal means about the inner side of the inner wall for sealably engaging the outer surface of the hanger.

33. Wellhead equipment of the character defined in claim 32, wherein the resilient seal means about the inner side of the inner wall comprises seal members carried about the inner side of the inner wall above and below the second and third ribs.

34. Wellhead equipment of the character defined in claim 32, wherein the first rib comprises upper and lower rib sections having a groove therebetween, and the resilient seal means about the inner side of the inner wall comprises a seal member carried within the groove.

35. Wellhead equipment of the character defined in claim 31, wherein the first leg is above the second leg and intersects with the inner wall near the intersection of the second leg therewith, and the first rib is generally horizontally opposite the intersection of the first and second legs with the inner wall.

36. Wellhead equipment of the character defined in claim 31, wherein the second leg is above the first leg, and the first rib is disposed generally vertically intermediate the intersection of the first and second legs with the inner wall.

37. Wellhead equipment of the character defined in claim 36, wherein the second rib is generally horizontally opposite the intersection of the upper leg with the inner wall, and the third rib is generally horizontally opposite the intersection of the lower leg with the inner wall.

38. Wellhead equipment of the character defined in claim 31, wherein the third rib is the first and first rib is the second to engage the tapered, outer surface of the casing hanger as the seal assembly is lowered into the space.

39. Wellhead equipment of the character defined in claim 38, wherein the casing hanger has an outer cylindrical surface which forms a lower continuation of its outer tapered surface, and the third rib moves downwardly into a position opposite the outer cylindrical surface as the second rib engages and is forced outwardly by the tapered surface.

40. Apparatus, comprising a first member having a bore therethrough, a second member disposable within the bore of the first member and having an outer surface which is tapered upwardly and inwardly at a relatively small angle with respect to the vertical to form a frusto-conically shaped annular space between it and a cylindrical portion of the bore of the first member, a seal assembly lowerable into the space for closing the same, said assembly including a metal body having a lower inner wall whose inner side is also tapered upwardly and inwardly at a relatively small angle to the vertical and which has means thereon slidable downwardly along the surface of the second member to flex the wall outwardly as the assembly is lowered into space, and vertically spaced legs extending from and surrounding the outer side of the wall, a first of the legs extending upwardly and outwardly and a second of the legs extending downwardly and outwardly from the wall at acute angles with respect to the horizontal so that the first leg is flexed upwardly and the second leg is flexed downwardly as their outer ends are forced against the bore of the first member by outward flexing of the inner wall.

41. Apparatus of the character defined in claim 40, including resilient seal means about the outer side of the inner wall above the first leg and below the second leg for sealably engaging the bore, and resilient seal means about the inner side of the inner wall for sealably engaging the outer surface of the second member.

42. Apparatus of the character defined in claim 41, wherein the first leg is above the second leg, and the resilient seal means about the outer side of the inner wall comprises an upper seal member confined within a recess above the upper leg and a lower seal member confined within a recess below the lower leg.

43. Apparatus of the character defined in claim 41, wherein the second leg is above the first leg, and the resilient seal means about the inner side of the inner wall comprises a seal member confined within a recess between the first and second legs.

44. Apparatus of the character defined in claim 40, wherein the means on the inner side of the inner wall slidable along the surface of the second member comprises a first rib thereabout generally vertically intermediate the legs.

45. Apparatus of the character defined in claim 44, wherein the means on the inner side of the inner wall also includes second and third ribs about the inner side of the inner wall above and below the first rib which are slidable over and forced tightly against the surface of the second member as the inner wall is flexed outwardly.

46. Apparatus of the charcter defined in claim 45, including resilient seal means about the outer side of the inner wall above the first leg and below the second leg for sealably engaging the bore, and resilient seal means about the inner side of the inner wall for sealably engaging the outer surface of the hanger.

47. Apparatus of the character defined in claim 46, wherein the resilient seal means about the inner side of the inner wall comprises seal members carried about the inner side of the inner wall above and below the second and third ribs.

48. Apparatus of the character defined in claim 46, wherein the first rib comprises upper and lower rib sections having a groove therebetween, and the resilient seal means about the inner side of the inner wall comprises a seal member carried within the groove.

49. Apparatus of the character defined in claim 45, wherein the first leg is above the second leg and intersects with the inner wall generally horizontally opposite the intersection of the second leg therewith, and the first rib is generally horizontally opposite the intersection of the first and second legs with the inner wall.

50. Apparatus of the charcter defined in claim 45, wherein the second leg is above the first leg, and the first rib is disposed generally vertically intermediate the the intersection of the first and second legs with the inner wall.

51. Apparatus of the character defined in claim 50, wherein the second rib is generally horizontally opposite the intersection of the leg with the inner wall, and the third rib is generally horizontally opposite the intersection of the lower leg with the inner wall.

52. Apparatus of the character defined in claim 45, wherein the third rib is the first and first rib is the second to engage the tapered, outer surface of the casing hanger as the seal assembly is lowered into the space.

53. Apparatus of the character defined in claim 52, wherein the second member has an outer cylindrical surface which forms a lower continuation of its outer tapered surface, and the third rib move downwardly into a position opposite the outer cylindrical surface as the second rib engages and is forced outwardly by the tapered surface.

* * * * *